US012788107B2

(12) United States Patent
Eldem et al.

(10) Patent No.: US 12,788,107 B2
(45) Date of Patent: Nov. 10, 2026

(54) SOLE STRUCTURE FOR ARTICLE OF FOOTWEAR

(71) Applicant: NIKE, Inc., Beaverton, OR (US)

(72) Inventors: Can Eldem, Portland, OR (US); Zachary M. Elder, Portland, OR (US); Cassidy R. Levy, West Linn, OR (US); Evan Perkins, Portland, OR (US); Emily Simmons, Beaverton, OR (US); Philip Woodman, Treviso (IT)

(73) Assignee: NIKE, Inc., Beaverton, OR (US)

( * ) Notice: Subject to any disclaimer, the term of this patent is extended or adjusted under 35 U.S.C. 154(b) by 0 days.

(21) Appl. No.: 19/051,617

(22) Filed: Feb. 12, 2025

(65) Prior Publication Data

US 2025/0176664 A1 Jun. 5, 2025

Related U.S. Application Data

(63) Continuation of application No. 17/711,457, filed on Apr. 1, 2022, now Pat. No. 12,250,987.
(Continued)

(51) Int. Cl.
*A43B 13/18* (2006.01)
*A43B 13/12* (2006.01)
*A43B 13/40* (2006.01)

(52) U.S. Cl.
CPC ..... *A43B 13/186* (2013.01); *A43B 13/122* (2013.01); *A43B 13/189* (2013.01); *A43B 13/40* (2013.01)

(58) Field of Classification Search
CPC ..... A43B 3/0063; A43B 13/06; A43B 13/122; A43B 13/141; A43B 13/16; A43B 13/186;
(Continued)

(56) References Cited

U.S. PATENT DOCUMENTS 1,468,072 A 9/1923 Ogle
4,817,304 A 4/1989 Parker et al.
(Continued)

FOREIGN PATENT DOCUMENTS

CN 109068795 A 12/2018
EP 0893074 A2 1/1999
(Continued)

OTHER PUBLICATIONS

United States Patent and Trademark Office, Non-Final Office Action for U.S. Appl. No. 17/734,717 mailed Jul. 1, 2022.
(Continued)

*Primary Examiner* — Matthew R Marchewka
(74) *Attorney, Agent, or Firm* — Honigman LLP; Matthew H. Szalach

(57) ABSTRACT

A sole structure for an article of footwear having an upper includes a midsole. The midsole may include a cushion and a chassis. The cushion extends from a forefoot region to a heel region of the sole structure. The chassis is disposed between a top side of the cushion and the upper. An outsole is mounted to a bottom surface of the midsole. The outsole includes a first outsole portion, a second outsole portion and a third outsole portion. The first outsole portion, the second outsole portion and the third outsole portion are spaced apart from each other so as to provide flexibility to the sole structure. The first outsole portion, the second outsole portion and the third outsole portion may be formed of a first material and a second material. The second material is more durable relative to the first material.

20 Claims, 17 Drawing Sheets

Related U.S. Application Data

(60) Provisional application No. 63/300,246, filed on Jan. 17, 2022, provisional application No. 63/300,259, filed on Jan. 17, 2022, provisional application No. 63/300,252, filed on Jan. 17, 2022, provisional application No. 63/253,022, filed on Oct. 6, 2021, provisional application No. 63/194,314, filed on May 28, 2021, provisional application No. 63/194,327, filed on May 28, 2021.

(58) Field of Classification Search
CPC ..... A43B 13/189; A43B 13/20; A43B 13/203; A43B 13/206
USPC ..... 36/25 R, 103
See application file for complete search history.

(56) References Cited

U.S. PATENT DOCUMENTS

| | | | | |
|---|---|---|---|---|
| 5,406,719 | A | 4/1995 | Potter | |
| D364,036 | S | 11/1995 | Passke et al. | |
| 5,595,004 | A | 1/1997 | Lyden | |
| 5,713,141 | A | 2/1998 | Mitchell | |
| 5,815,949 | A | 10/1998 | Sessa | |
| 5,952,065 | A | 9/1999 | Mitchell et al. | |
| 5,987,780 | A | 11/1999 | Lyden et al. | |
| 6,009,637 | A | 1/2000 | Pavone | |
| 6,253,466 | B1 | 7/2001 | Harmon-Weiss et al. | |
| 6,582,786 | B1 | 6/2003 | Bonk et al. | |
| 6,971,193 | B1 | 12/2005 | Potter et al. | |
| 7,451,555 | B1 | 11/2008 | Lakic | |
| 7,707,745 | B2 | 5/2010 | Schindler et al. | |
| 8,099,880 | B2 | 1/2012 | Brewer et al. | |
| 8,241,450 | B2 | 8/2012 | Hensley et al. | |
| 9,609,913 | B2 | 4/2017 | Bates et al. | |
| 10,070,690 | B2 | 9/2018 | Cortez et al. | |
| 10,149,513 | B1 | 12/2018 | Eldem et al. | |
| 10,524,540 | B1 | 1/2020 | Eldem et al. | |
| 2002/0053146 | A1* | 5/2002 | Swigart ..... | A43B 13/206 36/35 B |
| 2005/0132609 | A1 | 6/2005 | Dojan et al. | |
| 2005/0268490 | A1 | 12/2005 | Foxen | |
| 2006/0086003 | A1 | 4/2006 | Tseng | |
| 2007/0199213 | A1 | 8/2007 | Campbell et al. | |
| 2008/0276491 | A1 | 11/2008 | Gaensler et al. | |
| 2009/0151093 | A1 | 6/2009 | Schindler et al. | |
| 2010/0325914 | A1 | 12/2010 | Peyton | |
| 2011/0283560 | A1 | 11/2011 | Portzline et al. | |
| 2012/0174432 | A1 | 7/2012 | Peyton | |
| 2012/0324762 | A1 | 12/2012 | Soumokil et al. | |
| 2013/0192087 | A1 | 8/2013 | Litchfield et al. | |
| 2013/0247425 | A1 | 9/2013 | Davis et al. | |
| 2014/0230276 | A1 | 8/2014 | Campos, II et al. | |
| 2015/0113829 | A1 | 4/2015 | Kodad | |
| 2015/0272271 | A1 | 10/2015 | Campos, II et al. | |
| 2016/0021974 | A1 | 1/2016 | Schindler et al. | |
| 2016/0073732 | A1 | 3/2016 | Ernst et al. | |
| 2016/0120263 | A1 | 5/2016 | Cortez et al. | |
| 2017/0119096 | A1 | 5/2017 | Greene | |
| 2017/0265564 | A1 | 9/2017 | Peyton | |
| 2017/0265566 | A1 | 9/2017 | Case et al. | |
| 2018/0125162 | A1 | 5/2018 | Taylor et al. | |
| 2018/0132563 | A1 | 5/2018 | Hillyer et al. | |
| 2019/0365036 | A1 | 12/2019 | Meeker | |
| 2019/0380435 | A1 | 12/2019 | Campos, II et al. | |
| 2020/0022454 | A1 | 1/2020 | Eldem et al. | |
| 2020/0390189 | A1 | 12/2020 | Campos, II et al. | |
| 2021/0145117 | A1* | 5/2021 | Montross ..... | A43B 13/20 |
| 2021/0145118 | A1 | 5/2021 | Campos, II et al. | |
| 2021/0145119 | A1 | 5/2021 | Campos, II et al. | |

FOREIGN PATENT DOCUMENTS

| | | | |
|---|---|---|---|
| EP | 1109468 | A1 | 6/2001 |
| KR | 20020014022 | A | 2/2002 |
| KR | 20120130542 | A | 12/2012 |
| WO | WO-9807343 | A1 | 2/1998 |
| WO | WO-2017160946 | A1 | 9/2017 |

OTHER PUBLICATIONS

United States Patent and Trademark Office, Non-Final office action for U.S. Appl. No. 17/734,567, mailed Jul. 5, 2022.

United States Patent and Trademark Office, Non-Final Office Action for U.S. Appl. No. 17/734,798 mailed Jul. 18, 2022.

European Patent Office (ISA), International Search Report and Written Opinion for International Application No. PCT/US2022/023371, mailed Aug. 19, 2022.

China National Intellectual Property Administration, First Office Action for CN App. No. 202080031513.2, mailed Aug. 29, 2022.

European Patent Office as ISA, International Search Report and Written Opinion for App. No. PCT/US2020/067141, mailed Mar. 29, 2021.

European Patent Office (ISA), International Search Report and Written Opinion for PCT App. No. PCT/US2022/023362, mailed Jun. 21, 2022.

European Patent Office (ISA), International Search Report and Written Opinion for PCT App. No. PCT/US2022/023367, mailed Jun. 22, 2022.

USPTO, Non-Final Office Action for U.S. Appl. No. 17/711,812 mailed Dec. 6, 2023.

USPTO, Non-Final Office Action for U.S. Appl. No. 17/711,755 mailed Nov. 24, 2023.

* cited by examiner

SOLE STRUCTURE FOR ARTICLE OF FOOTWEAR

CROSS REFERENCE TO RELATED APPLICATIONS

This application is a continuation of U.S. Pat. No. 12,250,987, filed Apr. 1, 2022, which claims priority under 35 U.S.C. § 119(e) to U.S. Provisional Patent Application Ser. No. 63/300,259 filed Jan. 17, 2022, U.S. Provisional Patent Application Ser. No. 63/300,246 filed Jan. 17, 2022, U.S. Provisional Patent Application Ser. No. 63/300,252 filed Jan. 17, 2022, U.S. Provisional Patent Application Ser. No. 63/253,022 filed Oct. 6, 2021, U.S. Provisional Patent Application Ser. No. 63/194,327 filed May 28, 2021, and U.S. Provisional Patent Application Ser. No. 63/194,314, filed May 28, 2021, the disclosures of which are hereby incorporated by reference in their entireties.

FIELD

The present disclosure relates generally to sole structures for articles of footwear and, more particularly, to sole structures incorporating an outsole.

BACKGROUND

This section provides background information related to the present disclosure, which is not necessarily prior art.

Articles of footwear conventionally include an upper and a sole structure. The upper may be formed from any suitable material(s) to receive, secure, and support a foot on the sole structure. The upper may cooperate with laces, straps, or other fasteners to adjust the fit of the upper around the foot. A bottom portion of the upper, proximate to a bottom surface of the foot, attaches to the sole structure.

Sole structures generally include a layered arrangement extending between a ground surface and the upper. One layer of the sole structure includes an outsole that provides abrasion-resistance and traction with the ground surface. The outsole may be formed from rubber or other materials that impart durability and wear-resistance, as well as enhance traction with the ground surface. Another layer of the sole structure includes a midsole disposed between the outsole and the upper. The midsole provides cushioning for the foot and may be partially formed from a polymer foam material that compresses resiliently under an applied load to cushion the foot by attenuating ground-reaction forces. The midsole may additionally or alternatively incorporate a cushion member to increase durability of the sole structure, as well as to provide cushioning to the foot by compressing resiliently under an applied load to attenuate ground-reaction forces. The cushion member may be a fluid-filled bladder or a foam element. Sole structures may also include a comfort-enhancing insole or a sockliner located within a void proximate to the bottom portion of the upper and a strobel attached to the upper and disposed between the midsole and the insole or sockliner.

Midsoles employing fluid-filled bladders typically include a bladder formed from two barrier layers of polymer material that are sealed or bonded together. The fluid-filled bladders are pressurized with a fluid such as air, and may incorporate tensile members within the bladder to retain the shape of the bladder when compressed resiliently under applied loads, such as during athletic movements. Generally, bladders are designed with an emphasis on balancing support for the foot and cushioning characteristics that relate to responsiveness as the bladder resiliently compresses under an applied load. In such an aspect, the midsole may include a chassis for interfacing with the bladder so as to form a unitary structure.

Outsoles typically cover a bottom surface of the midsole and provide abrasion-resistance and traction with the ground surface. Such outsoles are typically formed as a single piece that is attached to the bottom surface of the midsole.

DRAWINGS

The drawings described herein are for illustrative purposes only of selected configurations and are not intended to limit the scope of the present disclosure.

Corresponding reference numerals indicate corresponding parts throughout the drawings.

DETAILED DESCRIPTION

Figure 1:
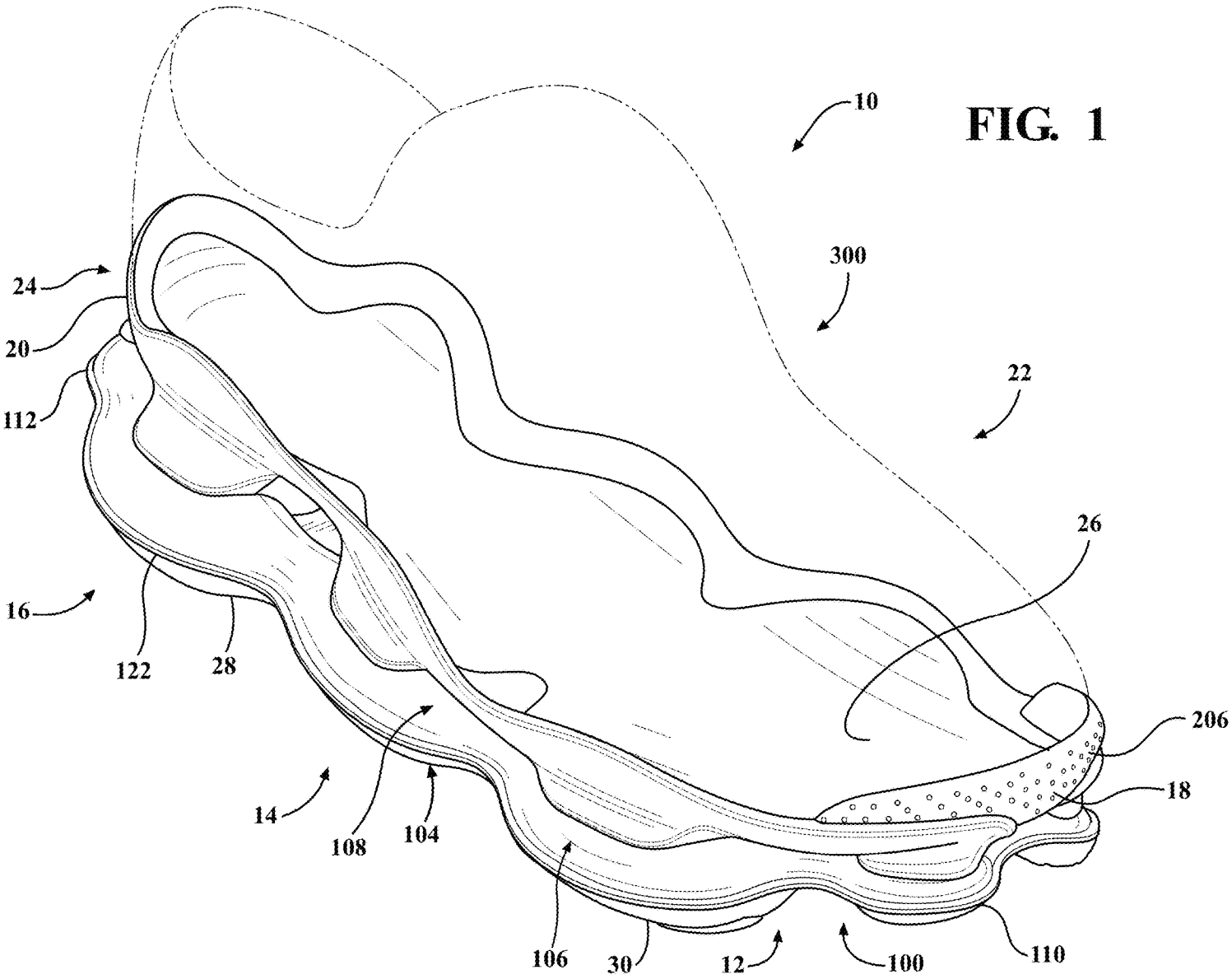
FIG. 1 is a perspective view of an article of footwear including a sole structure in accordance with principles of the present disclosure.

Example configurations will now be described more fully with reference to the accompanying drawings. Example configurations are provided so that this disclosure will be thorough, and will fully convey the scope of the disclosure to those of ordinary skill in the art. Specific details are set forth such as examples of specific components, devices, and methods, to provide a thorough understanding of configurations of the present disclosure. It will be apparent to those of ordinary skill in the art that specific details need not be employed, that example configurations may be embodied in many different forms, and that the specific details and the example configurations should not be construed to limit the scope of the disclosure.

The terminology used herein is for the purpose of describing particular exemplary configurations only and is not intended to be limiting. As used herein, the singular articles "a," "an," and "the" may be intended to include the plural forms as well, unless the context clearly indicates otherwise. The terms "comprises," "comprising," "including," and "having," are inclusive and therefore specify the presence of features, steps, operations, elements, and/or components, but do not preclude the presence or addition of one or more other features, steps, operations, elements, components, and/or groups thereof. The method steps, processes, and operations described herein are not to be construed as necessarily requiring their performance in the particular order discussed or illustrated, unless specifically identified as an order of performance. Additional or alternative steps may be employed.

When an element or layer is referred to as being "on," "engaged to," "connected to," "attached to," or "coupled to" another element or layer, it may be directly on, engaged, connected, attached, or coupled to the other element or layer, or intervening elements or layers may be present. In contrast, when an element is referred to as being "directly on," "directly engaged to," "directly connected to," "directly attached to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

The terms first, second, third, etc. may be used herein to describe various elements, components, regions, layers and/or sections. These elements, components, regions, layers and/or sections should not be limited by these terms. These terms may be only used to distinguish one element, component, region, layer or section from another region, layer or section. Terms such as "first," "second," and other numerical terms do not imply a sequence or order unless clearly indicated by the context. Thus, a first element, component, region, layer or section discussed below could be termed a second element, component, region, layer or section without departing from the teachings of the example configurations.

One aspect of the disclosure provides a sole structure. The sole structure includes a cushion and an outsole. The cushion includes a first series of lobes arranged from a forefoot region to a heel region along a medial side and lateral side of the sole structure. The outsole has a first side attached to the cushion and a second side disposed on an opposite side of the outsole than the first side. The second side defines a ground-contacting surface of the sole structure. The outsole includes a first outsole portion and a second outsole portion. The first outsole portion has a substantially U-shape and includes a first medial leg and a first lateral leg. The second outsole portion is spaced apart and separated from the first outsole portion and has a substantially U-shape including a second medial leg and a second lateral leg, the first medial leg, the first lateral leg, the second medial leg, and the second lateral leg extending toward an anterior end of the sole structure.

In some configurations, the cushion is a fluid-filled chamber. In another aspect, the cushion is a solid body. The cushion comprises or consists essentially of a cushion material including one or more polymers. In many examples, including when the cushion is a fluid-filled chamber, the cushion material comprises or consists essentially of a barrier membrane, the barrier membrane comprising a barrier material including one or more gas barrier compounds. The outsole comprises or consists essentially of an outsole material comprising one or more polymers. An article of footwear incorporating the sole structure disclosed herein is also provided.

Implementations of the disclosure may include one or more of the following optional features. In some implementations, the second outsole portion includes an interior leg extending in a direction away from the anterior end.

In some configurations, the interior leg extends between the first medial leg and the first lateral leg.

In some configurations, the second outsole portion includes an arcuate portion extending between and connecting the second medial leg and the second lateral leg, the interior leg extending from the arcuate portion.

The first outsole portion may include an arcuate portion extending between and connecting the first medial leg and the first lateral leg. The arcuate portion may extend along a posterior end of the sole structure in the heel region.

In some configurations, the outsole further includes a third outsole portion spaced apart and separated from the first outsole portion and the second outsole portion. The third outsole portion may include a third medial leg and a third lateral leg extending in a direction toward the anterior end of the sole structure. The third outsole portion may further include an arcuate portion extending between and connecting the third medial leg and the third lateral leg. The third outsole portion may further include a substantially U-shape. In another aspect of the third outsole portion, the third outsole portion includes an interior leg extending from the arcuate portion in a direction away from the anterior end. In such an aspect, the interior leg extends between the second medial leg and the second lateral leg.

In some configurations, a portion of the cushion is exposed between at least one of (i) the first outsole portion and the second outsole portion and (ii) between the second outsole portion and the third outsole portion.

In some configurations, the first outsole portion comprises or consists of a first outsole material, and the second outsole portion comprises or consists of a second material. In one example, the first outsole material and the second outsole material have substantially the same appearance, physical properties, and composition. Alternatively the first outsole material and the second outsole material may differ in one or more of appearance, physical properties, and composition.

Materials described herein may differ in one or more of appearance, physical properties, and composition. The materials may differ in appearance in terms of color (including in hue or lightness or both), or in terms of level of transparency or translucency, or in both color and level of transparency or translucency. The materials may differ in one or more physical properties, such as in hardness or in elongation or in both hardness and elongation. The one or more physical properties may differ by at least 5 percent or at least 10 percent or at least 20 percent. The materials may differ in composition. For example, the materials may differ based on the classes or types of polymers present, may differ based on a concentration of the classes or types of polymers, or based on both. The materials may differ in composition based the additives present, or based on a concentration of the additives present, or based on both. Optionally, the concentrations of the one or more polymers and/or one or more additives can differ by at least 5 weight percent or at least 10 weight percent or at least 20 weight percent of the material.

Another aspect of the disclosure provides an outsole for use with a sole structure. The sole structure includes a cushion including a first series of lobes arranged from a forefoot region to a heel region along a medial side and a lateral side of the sole structure. The sole structure further includes an outsole having a first side attached to the cushion, a second side disposed on an opposite side of the outsole than the first side and defining a ground-contacting surface of the sole structure. The outsole includes a first outsole portion and a second outsole portion. The first outsole portion has a substantially U-shape and includes a first medial leg and a first lateral leg. The second outsole portion is spaced apart and separated from the first outsole portion and has a substantially U-shape including a second medial leg and a second lateral leg. The first medial leg, the first lateral leg, the second medial leg, and the second lateral leg each include a longitudinal axis that extends substantially parallel to a longitudinal axis of the sole structure.

Implementations of the disclosure may include one or more of the following optional features. In some implementations, the second outsole portion includes an interior leg extending in a direction away from an anterior end of the sole structure. The interior leg may extend between the first medial leg and the first lateral leg.

In some configurations, the second outsole portion includes an arcuate portion extending between and connecting the second medial leg and the second lateral leg, the interior leg extending from the arcuate portion.

In some configurations, the first outsole portion includes an arcuate portion extending between and connecting the first medial leg and the first lateral leg. In one aspect, the arcuate portion extends along a posterior end of the sole structure in the heel region.

In some configurations, the outsole further includes a third outsole portion spaced apart and separated from the first outsole portion and the second outsole portion. In such an aspect, the third outsole portion includes a third medial leg and a third lateral leg extending in a direction toward an anterior end of the sole structure. The third outsole portion may include an arcuate portion extending between and connecting the third medial leg and the third lateral leg. The third outsole portion may include a substantially U-shape. In such an aspect, the third outsole portion includes an interior leg extending from the arcuate portion in a direction away from the anterior end. The interior leg may extend between the second medial leg and the second lateral leg. The third outsole portion may comprise or consist of a third outsole material, or may comprise or consist of the first outsole material or the second outsole material. The third outsole material may differ from the first outsole material, from the second outsole material, or from both based on one or more of appearance, physical properties, and composition, as described above.

In some configurations, a portion of the cushion is exposed between at least one of (i) the first outsole portion and the second outsole portion and (ii) between the second outsole portion and the third outsole portion.

In some configurations, the cushion is a fluid-filled chamber comprising a cushion material. In another aspect, the cushion is a solid body comprising a cushion material. In yet another aspect, the cushion comprises a solid, textile or foam element encapsulated in a barrier membrane. An article of footwear may incorporate the outsole.

Another aspect of the disclosure provides an outsole for use with a sole structure. The sole structure includes a cushion including a first series of lobes arranged from a forefoot region to a heel region along a medial side and a lateral side of the sole structure. The sole structure further includes an outsole having a first side attached to the cushion, a second side disposed on an opposite side of the outsole than the first side and defining a ground-contacting surface of the sole structure. The outsole includes a first outsole portion having a substantially U-shape and including a first medial leg and a first lateral leg, and a first insert attached to the first outsole portion and formed from a different material than the first outsole portion. In one example, the first outsole portion comprises a first outsole material, and the first insert comprises a second outsole material. The first outsole material and the second outsole material may have the same appearance, physical properties, and composition, or may differ in at least one of appearance, physical properties and composition as described above.

In some configurations, the first insert is disposed within a pocket defined by the first outsole portion and the first insert is attached one of the first medial leg and the first lateral leg.

In some configurations, a second insert is attached to the first outsole portion and optionally comprises a second outsole material, wherein the second insert is attached to the other of the first medial leg and the first lateral leg.

In some configurations, the first outsole portion includes an arcuate portion extending between and connecting the first medial leg and the first lateral leg.

In some configurations, a second outsole portion spaced apart and separated from the first outsole portion, wherein the second outsole portion includes a substantially U-shape having a second medial leg and a second lateral leg.

In some configurations, the cushion is a fluid-filled chamber. In another aspect, the cushion is a solid body. In yet another aspect, the cushion is a solid, textile or foam element encapsulated in a barrier element. An article of footwear may incorporate the outsole.

Referring to FIGS. 1-16, an article of footwear 10 includes a sole structure 100 and an upper 300 attached to the sole structure 100. The article of footwear 10 may be divided into one or more regions. The regions may include a forefoot region 12, a mid-foot region 14, and a heel region 16. The forefoot region 12 may be further described as including a toe portion 12T corresponding to the phalanges of the foot, and a ball portion 12B corresponding to a metatarsophalangeal (MTP) joint. The mid-foot region 14 may correspond with an arch area of the foot, and the heel region 16 may correspond with rear portions of the foot, including a calcaneus bone. The footwear 10 may further include an anterior end 18 associated with a forward-most point of the forefoot region 12, and a posterior end 20 corresponding to a rearward-most point of the heel region 16. A longitudinal axis A10 of the footwear 10 extends along a length of the footwear 10 from the anterior end 18 to the posterior end 20, and generally divides the footwear 10 into a medial side 22 and a lateral side 24, as shown in FIG. 1. Accordingly, the medial side 22 and the lateral side 24 respectively correspond with opposite sides of the footwear 10 and extend through the regions 12, 14, 16.

The article of footwear 10 and, more particularly, the sole structure 100, may be further described as including an interior region 26 and a peripheral region 28, as indicated in FIG. 1. The peripheral region 28 is generally described as being a region between the interior region 26 and an outer perimeter of the sole structure 100. Particularly, the peripheral region 28 extends from the forefoot region 12 to the heel region 16 along each of the medial side 22 and the lateral side 24, and wraps around each of the forefoot region 12 and the heel region 16. Thus, the interior region 26 is circumscribed by the peripheral region 28, and extends from the forefoot region 12 to the heel region 16 along a central portion of the sole structure 100.

Figure 2A:
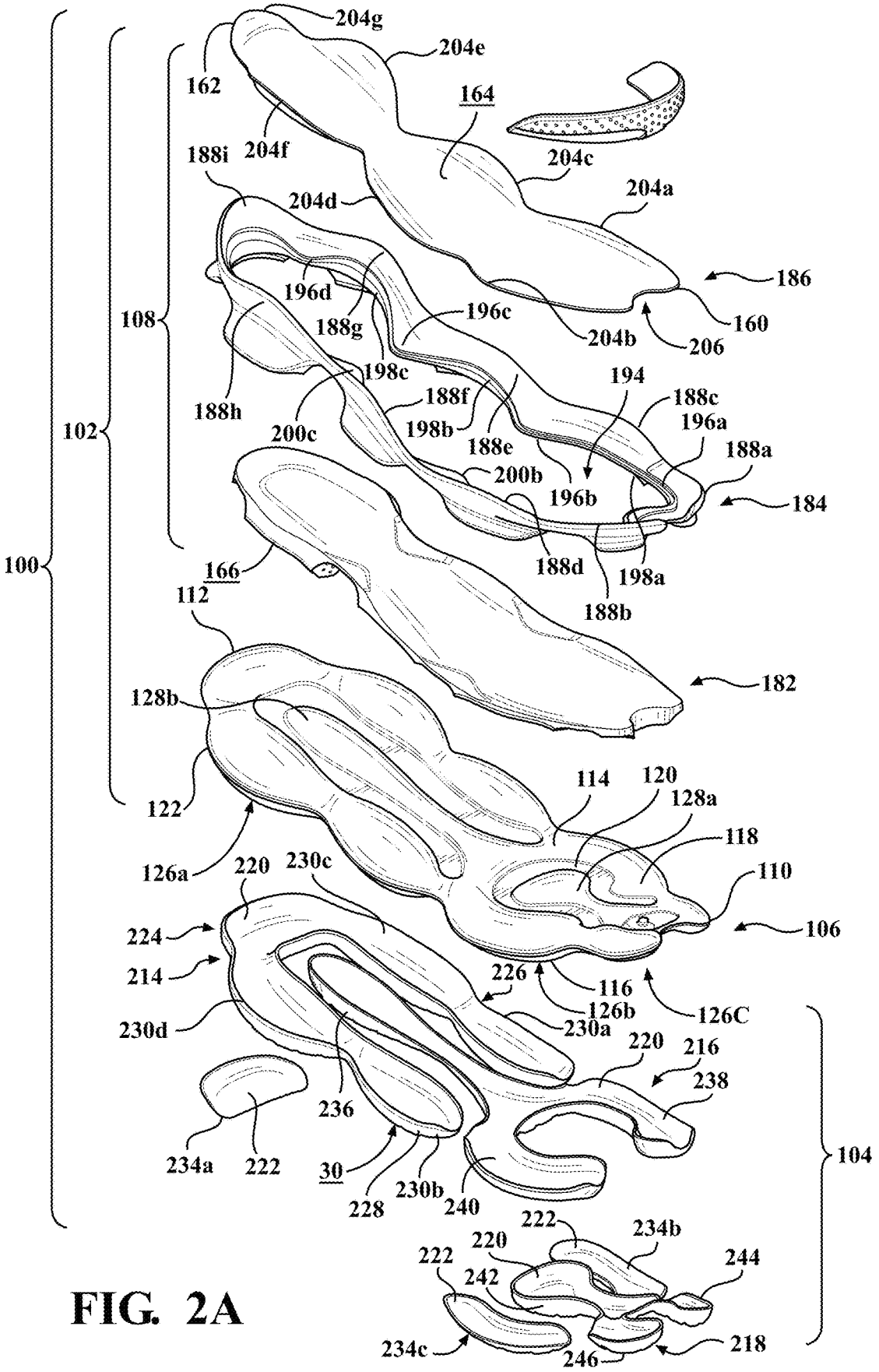
FIG. 2A is an exploded, top perspective view of the sole structure of FIG. 1.
Figure 2B:
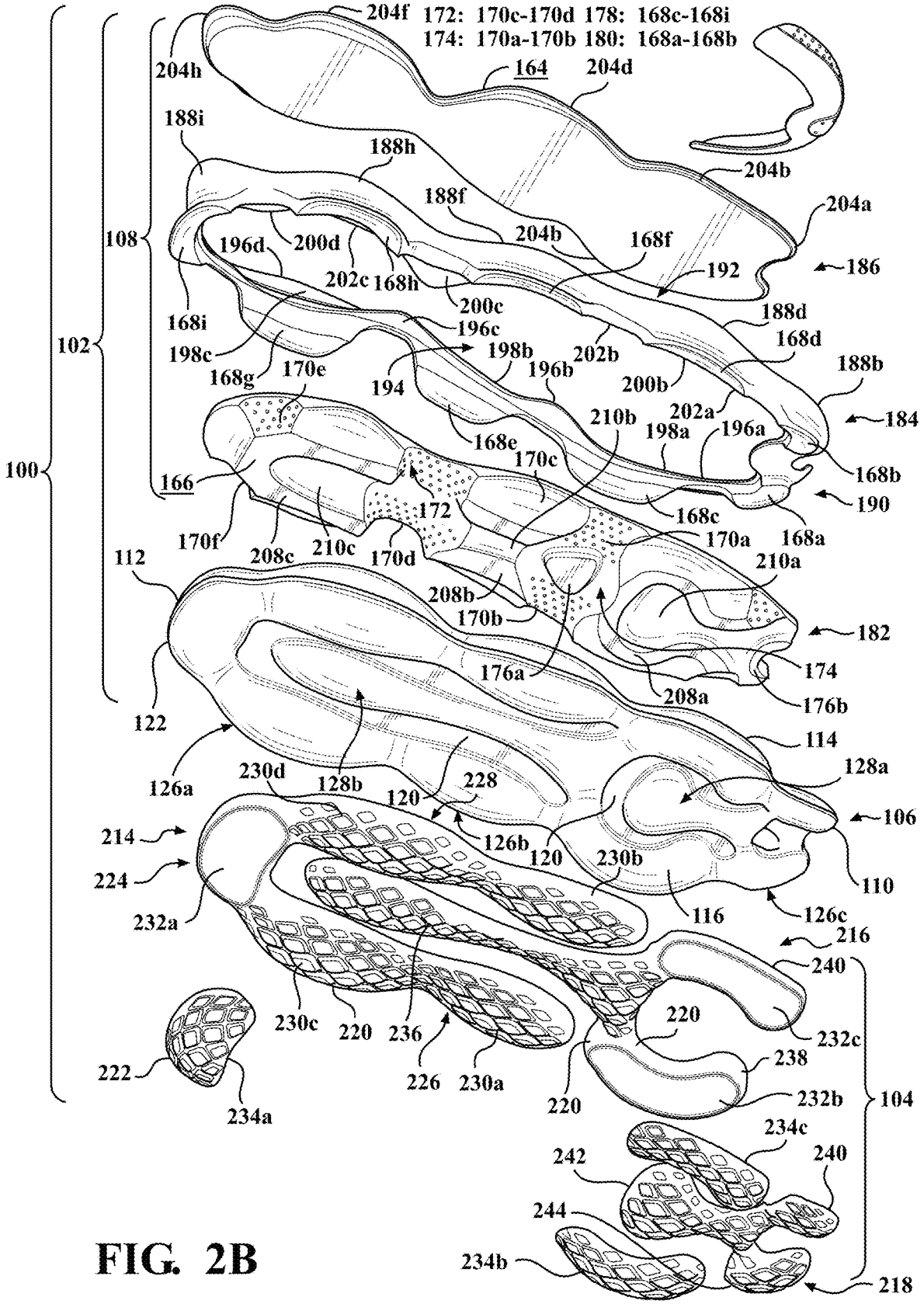
FIG. 2B is an exploded, bottom perspective view of the sole structure of FIG. 1.

With reference to FIGS. 2A and 2B, the sole structure 100 includes a midsole 102 configured to provide cushioning characteristics to the sole structure 100, and an outsole 104 configured to provide a ground-engaging surface 30*a* of the article of footwear 10. Unlike conventional sole structures, the midsole 102 of the sole structure 100 may be formed compositely and include a plurality of subcomponents for providing desired forms of cushioning and support throughout the sole structure 100. For example, the midsole 102 includes a cushion 106 and a chassis 108, where the chassis 108 is attached to the upper 300 and provides an interface between the upper 300 and the cushion 106.

With reference to FIGS. 1-5C, a longitudinal axis A106 (shown in FIGS. 5A-5C) of the cushion 106 extends from a first end 110 in the forefoot region 12 to a second end 112 in the heel region 16. The cushion 106 may be further described as including a top surface or side 114 and a bottom surface or side 116 formed on an opposite side of the cushion 106 from the top side 114. As discussed in greater detail below with respect to FIGS. 6A, 7 and 8, thicknesses T106 of the cushion 106, or of elements of the cushion 106, are defined by a distance from the top side 114 to the bottom side 116.

The cushion member 106 is configured to provide cushioning for the foot by attenuating ground-reaction forces. In one aspect, the cushion member 106 is a fluid-filled bladder 106A and in another aspect, the cushion member 106 is a foam element 106B. The difference between the fluid-filled bladder 106A and the foam element 106B being the attenuation of ground-reaction forces. For instance, when the cushion member 106 is a fluid-filled bladder 106A, the fluid (air) is contained within the fluid-filled bladder 106A itself. Thus, the fluid within the fluid-filled bladder 106A is displaced at the location(s) of a ground-reaction and is forced into other areas of the fluid-filled bladder 106A in the form of a reaction force. However, in instances where the cushion member 106 is a foam element 106B, the ground-reaction forces are absorbed by the foam element at the point of impact. As such, the remaining portions of the foam element 106B do not experience the reaction force in the same way as the fluid-filled bladder 106A. Such a feature may be preferable for users who desire a more cushioned response in comparison to the cushioning provided by the fluid-filled bladder 106A.

Figure 6A:
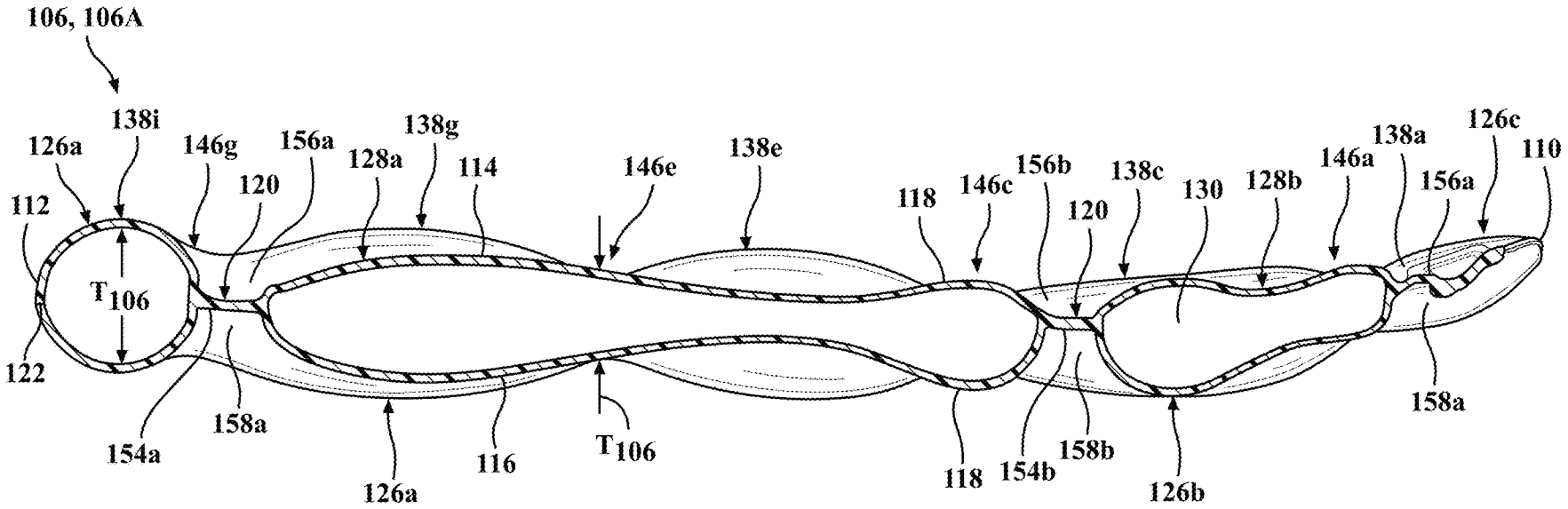
FIG. 6A is a cross-sectional view of the cushion of FIG. 3, taken along Line 6A-6A of FIG. 5A.
Figure 8:
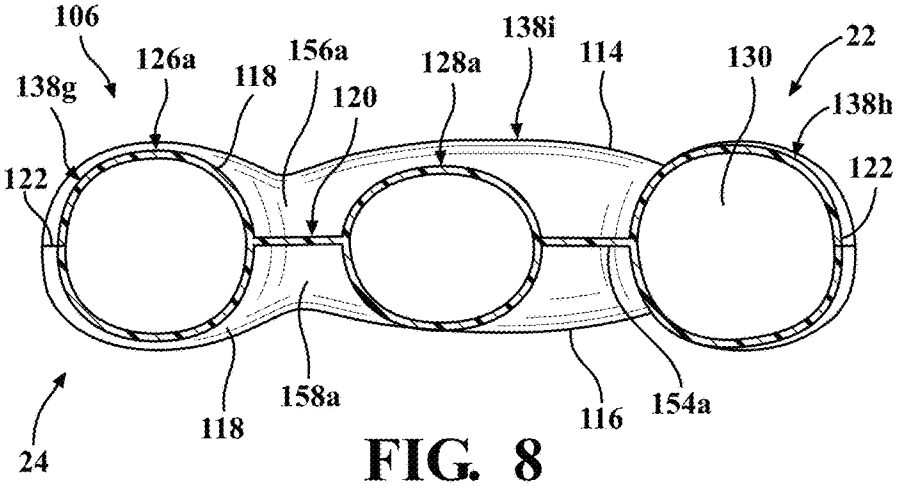
FIG. 8 is a cross-sectional view of the cushion of FIG. 3 taken along Line 8-8 of FIG. 5A.
Figure 7:
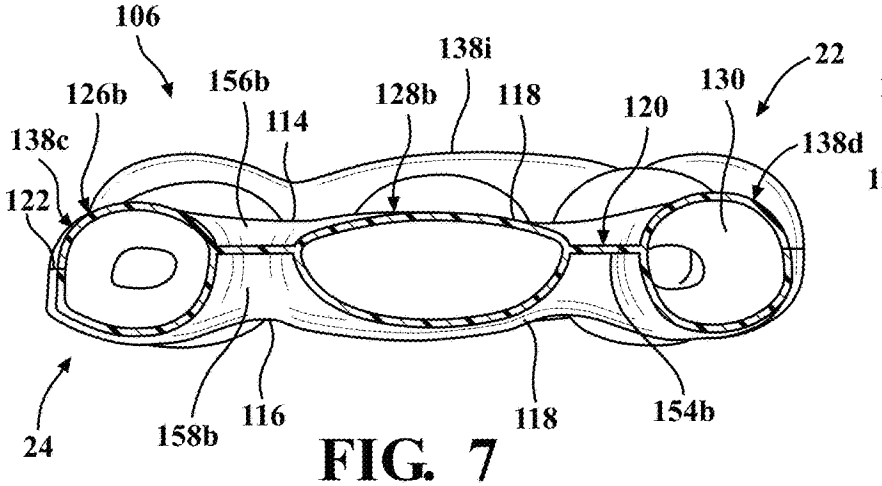
FIG. 7 is a cross-sectional view of the cushion of FIG. 3, taken along Line 7-7 of FIG. 5A.

As shown in the cross-sectional views of FIGS. 6A, 7 and 8, the cushion 106 is a fluid-filled bladder 106A that may be formed by an opposing pair of barrier layers 118, which can be joined to each other at discrete locations to define an overall shape of the cushion 106. Alternatively, the bladder 106A can be produced from any suitable combination of one or more barrier layers. As used herein, the term "barrier layer" (e.g., barrier layers 118) encompasses both monolayer and multilayer films. In some configurations, one or both of the barrier layers 118 are each produced (e.g., thermoformed or blow molded) from a monolayer film (a single layer). In other configurations, one or both of the barrier layers 118 are each produced (e.g., thermoformed or blow molded) from a multilayer film (multiple sublayers). In either aspect, each layer or sublayer can have a film thickness ranging from about 0.2 micrometers to about 1 millimeter. In further configurations, the film thickness for each layer or sublayer can range from about 0.5 micrometers to about 500 micrometers. In yet further configurations, the film thickness for each layer or sublayer can range from about 1 micrometer to about 100 micrometers.

One or both of the barrier layers 118 can independently be transparent, translucent, and/or opaque. As used herein, the term "transparent" for a barrier layer and/or a bladder means that light passes through the barrier layer in substantially straight lines and a viewer can see through the barrier layer. In comparison, for an opaque barrier layer, light does not pass through the barrier layer and one cannot see clearly through the barrier layer at all. A translucent barrier layer falls between a transparent barrier layer and an opaque barrier layer, in that light passes through a translucent layer but some of the light is scattered so that a viewer cannot see clearly through the layer.

In one aspect, the airbags or bladders disclosed herein comprise or consist of a barrier membrane. As used herein, a barrier membrane is understood to be a membrane having a relatively low rate of transmittance of a fluid. When used alone or in combination with other materials in an airbag or bladder, the barrier membrane resiliently retains the fluid. Depending upon the structure and use of the airbag or bladder, the barrier membrane may retain the fluid at a pressure which is above, at, or below atmospheric pressure. In some aspects, the fluid is a liquid or a gas. Examples of gasses include air, oxygen gas ($O_2$), and nitrogen gas ($N_2$), as well as inert gasses. In one aspect, the barrier membrane is a nitrogen gas barrier material.

The gas transmission rate of the barrier membrane can be less than 4 or less than 3 or less than 2 cubic centimeters per square meter per atmosphere per day per day for a membrane having a thickness of from about 72 micrometers to about 320 micrometers, as measured at 23 degrees Celsius and 0 percent relative humidity. In another example, the gas transmission rate of the barrier membrane is from about 0.1 to about 3, or from about 0.5 to about 3, or from about 0.5 to about 3 cubic centimeters per square meter per atmosphere per day per day for a membrane having a thickness of from about 72 micrometers to about 320 micrometers, as measured at 23 degrees Celsius and 0 percent relative humidity. The gas transmission rate, such as the oxygen gas or nitrogen gas transmission rate, can be measured using ASTM D1434.

In one aspect, the barrier membrane comprise a multi-layered film comprising a plurality of layers, the plurality of layers comprising one or more barrier layers, the one or more barrier layers comprising a barrier material, the barrier material comprising or consisting essentially of one or more gas barrier compounds. The multi-layered film comprises at least 5 layers or at least 10 layers. Optionally, the multi-layered film comprises from about 5 to about 200 layers, from about 10 to about 100 layers, from about 20 to about 80 layers, from about 20 to about 50 layers, or from about 40 to about 90 layers.

In one aspect of a multi-layered film, the plurality of layers includes a series of alternating layers, in which the alternating layers include two or more barrier layers, each of the two or more barrier layers individually comprising a barrier material, the barrier material comprising or consisting essentially of one or more gas barrier compounds. In the series of alternating layers, adjacent layers are individually formed of materials which differ from each other at least in their chemical compositions based on the individual components present (e.g., the materials of adjacent layers may differ based on whether or not a gas barrier compound is present, or differ based on class or type of gas barrier compound present), the concentration of the individual components present (e.g., the materials of adjacent layers may differ based on the concentration of a specific type of gas barrier compound present), or may differ based on both the components present and their concentrations.

The plurality of layers of the multi-layered film can include first barrier layers comprising a first barrier material and second barrier layers comprising a second barrier material, wherein the first and second barrier materials differ from each other based as described above. The first barrier material can be described as comprising a first gas barrier component consisting of all the gas barrier compounds present in the first barrier material, and the second barrier material can be described as comprising a second barrier material component consisting of all the gas barrier compounds present in the second barrier material. In a first example, the first barrier component consists only of one or more gas barrier polymers, and the second barrier component consists only of one or more inorganic gas barrier compounds. In a second example, the first barrier component consists of a first one or more gas barrier polymers, and the second component consists of a second one or more gas barrier polymers, wherein the first one or more gas barrier polymers differ from the second one or more gas barrier polymers in polymer class, type, or concentration. In a third example, the first barrier component and the second barrier component both include the same type of gas barrier compound, but the concentration of the gas barrier compound differ, optionally the concentrations differ by at least 5 weight percent based on the weight of the barrier material. In these multi-layered films, the first barrier layers and the second barrier layers can alternate with each other, or can alternate with additional barrier layers (e.g., third barrier layers comprising a third barrier material, fourth barrier layers comprising a fourth barrier material, etc., wherein each of the first, second, third and fourth, etc., barrier materials differ from each other as described above.

The barrier material (including a first barrier material, a second barrier material, etc.) has a low gas transmittance rate. For example, when formed into a single-layer film consisting essentially of the barrier material, the single-layer film has a gas transmittance rate of less than 4 cubic centimeters per square meter per atmosphere per day per day for a membrane having a thickness of from about 72 micrometers to about 320 micrometers, as measured at 23 degrees Celsius and 0 percent relative humidity, and can be measured using ASTM D1434. The barrier material comprises or consists essentially of one or more gas barrier compounds. The one or more gas barrier compounds can comprise one or more gas barrier polymers, or can comprise one or more inorganic gas barrier compound, or can comprise a combination of at least one gas barrier polymer and at least one inorganic gas barrier compound. The combination of at least one gas barrier polymer and at least one inorganic gas barrier compound can comprise a blend or mixture, or can comprise a composite in which fibers, particles or platelets of the inorganic gas barrier compound are surrounded by the gas barrier polymer.

In one aspect, the barrier material comprises or consists essentially of one or more inorganic gas barrier compounds. The one or more inorganic gas barrier compounds can take the form of fibers, particulates, platelets, or combinations thereof. The fibers, particulates, platelets can comprise or consist essentially of nanoscale fibers, particulates, platelets, or combinations thereof. Examples of inorganic barrier compounds includes, for example, carbon fibers, glass fibers, glass flakes, silicas, silicates, calcium carbonate, clay, mica, talc, carbon black, particulate graphite, metallic flakes, and combinations thereof. The inorganic gas barrier component can comprise or consist essentially of one or more clays. Examples of suitable clays include bentonite, montmorillonite, kaolinite, and mixtures thereof. In one example, the inorganic gas barrier component consists of clay. Optionally, the barrier material can further comprise one or more additional ingredients, such as a polymer, processing aid, colorant, or any combination thereof. In aspects where the barrier material comprises or consists essentially of one or more inorganic barrier compounds, the barrier material can be described as comprising an inorganic gas barrier component consisting of all inorganic barrier compounds present in the barrier material. When one or more inorganic gas barrier compounds are included in the barrier material, the total concentration of the inorganic gas barrier component present in the barrier material can be less than 60 weight percent, or less than 40 weight percent, or less than 20 weight percent of the total composition. Alternatively, in other examples, the barrier material consists essentially of the one or more inorganic gas barrier materials.

In one aspect, the gas barrier compound comprises or consists essentially of one or more gas barrier polymers. The one or more gas barrier polymers can include thermoplastic polymers. In one example, the barrier material can comprise or consist essentially of one or more thermoplastic polymers, meaning that the barrier material comprises or consists essentially of a plurality of thermoplastic polymers, including thermoplastic polymers which are not gas barrier polymers. In another example, the barrier material comprises or consists essentially of one or more thermoplastic gas barrier polymers, meaning that all the polymers present in the barrier material are thermoplastic gas barrier polymers. The barrier material can be described as comprising a polymeric component consisting of all polymers present in the barrier material. For example, the polymeric component of the barrier material can consist of a single class of gas barrier polymer, such as, for example, one or more polyolefin, or can consist of a single type of gas barrier polymer, such as one or more ethylene-vinyl alcohol copolymers. Optionally, the barrier material can further comprise one or more non-polymeric additives, such as one or more filler, processing aid, colorant, or combination thereof.

Many gas barrier polymers are known in the art. Examples of gas barrier polymers include vinyl polymers such as vinylidene chloride polymers, acrylic polymers such as acrylonitrile polymers, polyamides, epoxy polymers, amine polymers, polyolefins such as polyethylenes and polypropylenes, copolymers thereof, such as ethylene-vinyl alcohol copolymers, and mixtures thereof. Examples of thermoplastic gas barrier polymers include thermoplastic vinyl homopolymers and copolymers, thermoplastic acrylic homopolymers and copolymers, thermoplastic amine homopolymers and copolymers, thermoplastic polyolefin homopolymers and copolymers, and mixtures thereof. In one example, the one or more gas barrier polymers comprise or consist essentially of one or more thermoplastic polyethylene copolymers, such as, for example, one or more thermoplastic ethylene-vinyl alcohol copolymers. The one or more ethylene-vinyl alcohol copolymers can include from about 28 mole percent to about 44 mole percent ethylene content, or from about 32 mole percent to about 44 mole percent ethylene content. In yet another example, the one or more gas barrier polymers can comprise or consist essentially of one or more one or more polyethyleneimine, polyacrylic acid, polyethyleneoxide, polyacrylamide, polyamidoamine, or any combination thereof.

In another aspect, in addition to the one or more barrier layers (e.g., including first barrier layers, second barrier layers, etc.), the multi-layered film further comprises one or more second layers, the one or more second layers comprising a second material. In one such configuration of the multi-layered film, the one or more barrier layers include a plurality of barrier layers alternating with a plurality of second layers. For example, each of the one or more barrier layers may be positioned between two second layers (e.g., with one second layer positioned on a first side of the barrier layer, and another second layer on a second side of the barrier layer, the second side opposing the first side).

The second material of the one or more second layers can comprise one or more polymers. Depending upon the class of gas barrier compounds used and the intended use of the multi-layered film, the second material may have a higher gas transmittance rate than the barrier material, meaning that the second material is a poorer gas barrier than the barrier material. In some aspects, the one or more second layers act as substrates for the one or more barrier layers, and may serve to increase the strength, elasticity, and/or durability of the multi-layered film. Alternatively or additionally, the one or more second layers may serve to decrease the amount of gas barrier material(s) needed, thereby reducing the overall material cost. Even when the second material has a relatively high gas transmittance rate, the presence of the one or more second layers, particularly when the one or more second layers are positioned between one or more barrier layers, may help maintain the overall barrier properties of the film by increasing the distance between cracks in the barrier layers, thereby increasing the distance gas molecules must travel between cracks in the barrier layers in order to pass through the multi-layered film. While small fractures or cracks in the barrier layers of a multi-layered film may not significantly impact the overall barrier properties of the film, using a larger number of thinner barrier layers can avoid or reduce visible cracking, crazing or hazing of the multi-layered film. The one or more second layers can include, but are not limited to, tie layers adhering two or more layers together, structural layers providing mechanical support to the multi-layered films, bonding layers providing a bonding material such as a hot melt adhesive material to the multi-layered film, and/or cap layers providing protection to an exterior surface of the multi-layered film.

In some aspects, the second material is an elastomeric material comprising or consisting essentially of at least one elastomer. Many gas barrier compounds are brittle and/or relatively inflexible, and so the one or more barrier layers may be susceptible to cracking when subjected to repeated, excessive stress loads, such as those potentially generated during flexing and release of a multi-layered film. A multi-layered film which includes one or more barrier layers alternating with second layers of an elastomeric material results in a multi-layered film that is better able to withstand repeated flexing and release while maintaining its gas barrier properties, as compared to a film without the elastomeric second layers present.

The second material comprises or consists essentially of one or more polymers. As used herein, the one or more polymers present in the second material are referred to herein as one or more "second polymers" or a "second polymer", as these polymers are present in the second material. References to "second polymer(s)" are not intended to indicate that a "first polymer" is present, either in the second material, or in the multi-layered film as a whole, although, in many aspects, multiple classes or types of polymers are present. In one aspect, the second material comprises or consists essentially of one or more thermoplastic polymers. In another aspect, the second material comprises or consists essentially of one or more elastomeric polymers. In yet another aspect, the second material comprises or consists essentially of one or more thermoplastic elastomers. The second material can be described as comprising a polymeric component consisting of all polymers present in the second material. In one example, the polymeric component of the second material consists of one or more elastomers. Optionally, the second material can further comprise one or more non-polymeric additives, such as fillers, processing aids, and/or colorants.

Many polymers which are suitable for use in the second material are known in the art. Exemplary polymers which can be included in the second material (e.g., second polymers) include polyolefins, polyamides, polycarbonates, polyimines, polyesters, polyacrylates, polyesters, polyethers, polystyrenes, polyureas, and polyurethanes, including homopolymers and copolymers thereof (e.g., polyolefin homopolymers, polyolefin copolymers, etc.), and combinations thereof. In one example, the second material comprises or consists essentially of one or more polymers chosen from polyolefins, polyamides, polyesters, polystyrenes, and polyurethanes, including homopolymers and copolymers thereof, and combinations thereof. In another example, the polymeric component of the second material consists of one or more thermoplastic polymers, or one or more elastomers or one or more thermoplastic elastomers, including thermoplastic vulcanizates. Alternatively, the one or more second polymers can include one or more thermoset or thermosettable elastomers, such as, for example, natural rubbers and synthetic rubbers, including butadiene rubber, isoprene rubber, silicone rubber, and the like.

Polyolefins are a class of polymers which include monomeric units derived from simple alkenes, such as ethylene, propylene and butene. Examples of thermoplastic polyolefins include polyethylene homopolymers, polypropylene homopolymers polypropylene copolymers (including polyethylene-polypropylene copolymers), polybutene, ethylene-octene copolymers, olefin block copolymers; propylene-butane copolymers, and combinations thereof, including blends of polyethylene homopolymers and polypropylene homopolymers. Examples of polyolefin elastomers include polyisobutylene elastomers, poly(alpha-olefin) elastomers, ethylene propylene elastomers, ethylene propylene diene monomer elastomers, and combinations thereof.

Polyamides are a class of polymers which include monomeric units linked by amide bonds. Naturally-occurring polyamides include proteins such as wool and silk, and synthetic amides such as nylons and aramids. The one or more second polymers can include thermoplastic polyamides such as nylon 6, nylon 6-6, nylon-11, as well as thermoplastic polyamide copolymers.

Polyesters are a class of polymers which include monomeric units derived from an ester functional group, and are commonly made by condensing dibasic acids such as, for example, terephthalic acid, with one or more polyols. In one example, the second material can comprise or consist essentially of one or more thermoplastic polyester elastomers. Examples of polyester polymers include homopolymers such as polyethylene terephthalate, polybutylene terephthalate, poly-1,4-cyclohexylene-dimethylene terephthalate, as well as copolymers such as polyester polyurethanes.

Styrenic polymers are a class of polymers which include monomeric units derived from styrene. The one or more second polymers can comprise or consist eseentially of styrenic homopolymers, styrenic random copolymers, styrenic block copolymers, or combinations thereof. Examples of styrenic polymers include styrenic block copolymers, such as acrylonitrile butadiene styrene block copolymers, styrene acrylonitrile block copolymers, styrene ethylene butylene styrene block copolymers, styrene ethylene butadiene styrene block copolymers, styrene ethylene propylene styrene block copolymers, styrene butadiene styrene block copolymers, and combinations thereof.

Polyurethanes are a class of polymers which include monomeric units joined by carbamate linkages. Polyurethanes are most commonly formed by reacting a polyisocyanate (e.g., a diisocyanate or a triisocyanate) with a polyol (e.g., a diol or triol), optionally in the presence of a chain extender. The monomeric units derived from the polyisocyanate are often referred to as the hard segments of the polyurethane, while the monomeric units derived from the polyols are often referred to as the soft segments of the polyurethane. The hard segments can be derived from aliphatic polyisocyanates, or from organic isocyanates, or from a mixture of both. The soft segments can be derived from saturated polyols, or from unsaturated polyols such as polydiene polyols, or from a mixture of both. When the multi-layered film is to be bonded to natural or synthetic rubber, including soft segments derived from one or more polydiene polyols can facilitate bonding between the rubber and the film when the rubber and the film are crosslinked in contact with each other, such as in a vulcanization process.

Examples of suitable polyisocyanates from which the hard segments of the polyurethane can be derived include hexamethylene diisocyanate (HDI), isophorone diisocyanate (IPDI), butylenediisocyanate (BDI), bisisocyanatocyclohexylmethane (HMDI), 2,2,4-trimethylhexamethylene diisocyanate (TMDI), bisisocyanatomethylcyclohexane, bisisochanatomethyltricyclodecane, norbornane diisocyanate (NDI), cyclohexane diisocyanate (CHDI), 4,4'-dicyclohexhylmethane diisocyanate (H12MDI), diisocyanatododecane, lysine diisocyanate, toluene diisocyanate (TDI), TDI adducts with trimethylolpropane (TMP), methylene diphenyl diisocyanate (MDI), xylene diisocyanate (XDI), tetramethylxylylene diisocyanate (TMXDI), hydrogenated xylene diisocyanate (HXDI), naphthalene 1,5-diisocyanate (NDI), 1,5-tetrahydronaphthalene diisocyanate, para-phenylene diisocyanate (PPDI), 3,3'-dimethyldiphenyl-4,4'-diisocyanate (DDDI), 4,4'-dibenzyl diisocyanate (DBDI), 4-chloro-1,3-phenylene diisocyanate, and any combination thereof. In one aspect, the polyurethane comprises or consists essentially of hard segments derived from toluene diisocyanate (TDI), or from methylene diphenyl diisocyanate (MDI), or from both.

The soft segments of the polyurethane can be derived from a wide variety of polyols, including polyester polyols, polyether polyols, polyester-ether polyols, polycarbonate polyols, polycaprolactone polyethers, and combinations thereof. In one aspect, the polyurethane comprises or consist essentially of monmeric units derived from $C_4$-$C_{12}$ polyols, or $C_6$-$C_{10}$ polyols, or $C_8$ or lower polyols, meaning polyols with 4 to 12 carbon molecules, or with 6 to 10 carbon molecules, or with 8 or fewer carbon molecules in their chemical structures. In another aspect, the polyurethane comprises or consists essentially of monomeric units derived from polyester polyols, polyester-ether polyols, polyether polyols, and any combination thereof. In yet another aspect, the polyurethane comprises or consists essentially of soft segments derived from polyols or diols having polyester functional units. The soft segments derived from polyols or diols having polyester functional units can comprise about 10 to about 50, or about 20 to about 40, or about 30 weight percent of the soft segments present in the polyurethane.

The multi-layered films can be produced by various means such as co-extrusion, lamination, layer-by-layer deposition, and the like. When co-extruding one or more barrier layers alone or with one or more second layers, selecting materials (e.g., a first barrier material and a second barrier material, or a single barrier material and a second material) having similar processing characteristics such as melt temperature and melt flow index, can reduce interlayer shear during the extrusion process, and can allow the alternating barrier layers and second layers to be co-extruded while retaining their structural integrities and desired layer thicknesses. In one example, the one or more barrier materials and optionally the second material when used, can be extruded into separate individual films, which can then be laminated together to form the multi-layered films.

The multi-layered films can be produced using a layer-by-layer deposition process. A substrate, which optionally can comprise a second material or a barrier material, can be built into a multi-layered film by depositing a plurality of layers onto the substrate. The layers can include one or more barrier layers (e,g., first barrier layers, second barrier layers, etc.). Optionally, the layers can include one or more second layers. The one or more barrier layers and/or second layers can be deposited by any means known in the art such as, for example, dipping, spraying, coating, or another method. The one or more barrier layers can be applied using charged solutions or suspensions, e.g., cationic solutions or suspensions or anionic solutions or suspensions, including a charged polymer solution or suspension. The one or more barrier layers can be applied using a series of two or more solutions having opposite charges, e.g., by applying a cationic solution, followed by an anionic solution, followed by a cationic solution, followed by an anionic solution, etc.

The barrier membranes, including the multi-layered films, have an overall thickness of from about 40 micrometers to about 500 micrometers, or about 50 micrometers to about 400 micrometers, or about 60 micrometers to about 350 micrometers. In one aspect, each individual layer of the plurality of layers of the multi-layered film has a thickness of from about 0.001 micrometers to about 10 micrometers. For example, the thickness of an individual barrier layer can range from about 0.001 micrometers to about 3 micrometers thick, or from about 0.5 micrometers to about 2 micrometers thick, or from about 0.5 micrometers to about 1 micrometer thick. The thickness of an individual second layer can range from about 2 micrometers to about 8 micrometers thick, or from about 2 micrometers to about 4 micrometers thick.

In a further aspect, thickness of the films and/or their individual layers can be measured by any method known in the art such as, for example, ASTM E252, ASTM D6988, ASTM D8136, or using light microscopy or electron microscopy.

In some aspects, the barrier membranes, including the multi-layered films, have a Shore hardness of from about 35 A to about 95 A, optionally from about 55 A to about 90 A. In these aspects, hardness can be measured using ASTM D2240 using the Shore A scale.

In one aspect, when a co-extrusion process is used to form the barrier membrane from a plurality of alternating barrier layers and second layers, the barrier material has a melt flow index of from about 5 to about 7 grams per 10 minutes at 190 degrees Celsius when using a weight of 2.16 kilograms, while the second material has a melt flow index of from about 20 to about 30 grams per 10 minutes at 190 degrees Celsius when using a weight of 2.16 kilograms. In a further aspect, the melt flow index of the barrier material is from about 80 percent to about 120 percent of the melt flow index of the barrier material per 10 minutes when measured at 190 degrees Celsius when using a weight of 2.16 kilograms. In these aspects, melt flow index can be measured using ASTM D1238. Alternatively or additionally, the barrier material or the second material or both have a melting temperature of from about 165 degrees Celsius to about 183 degrees Celsius, or from about 155 degrees Celsius to about 165 degrees Celsius. In one such example, the barrier material has a melting temperature of from about 165 degrees Celsius to about 183 degrees Celsius, while the second material has a melting temperature of from about 155 degrees Celsius to about 165 degrees Celsius. Further in these aspects, melting temperature can be measured using ASTM D3418.

In the shown configuration, the barrier layers 118 include a first, upper barrier layer 118 forming the top side 114 of the bladder 106A, and a second, lower barrier layer 118 forming the bottom side 116 of the bladder 106A. In the illustrated example, interior, opposing surfaces (i.e. facing each other) of the barrier layers 118 are joined together at discrete locations to form a web area 120 and a peripheral seam 122. The peripheral seam 122 extends around the outer periphery of the bladder 106A and defines an outer peripheral profile of the bladder 106A. As shown in FIGS. 3, 4, 5A, 6A, 7, and 8, the upper and lower barrier layers 118 are spaced apart from each other between the web area 120 and the peripheral seam 122 to define a plurality of chambers 124 including a plurality of peripheral chambers 126*a*-126*c*, and a plurality of interior chambers 128*a*-128*b* each forming a respective portion of an interior void 130 of the bladder 106A.

Figure 5A:
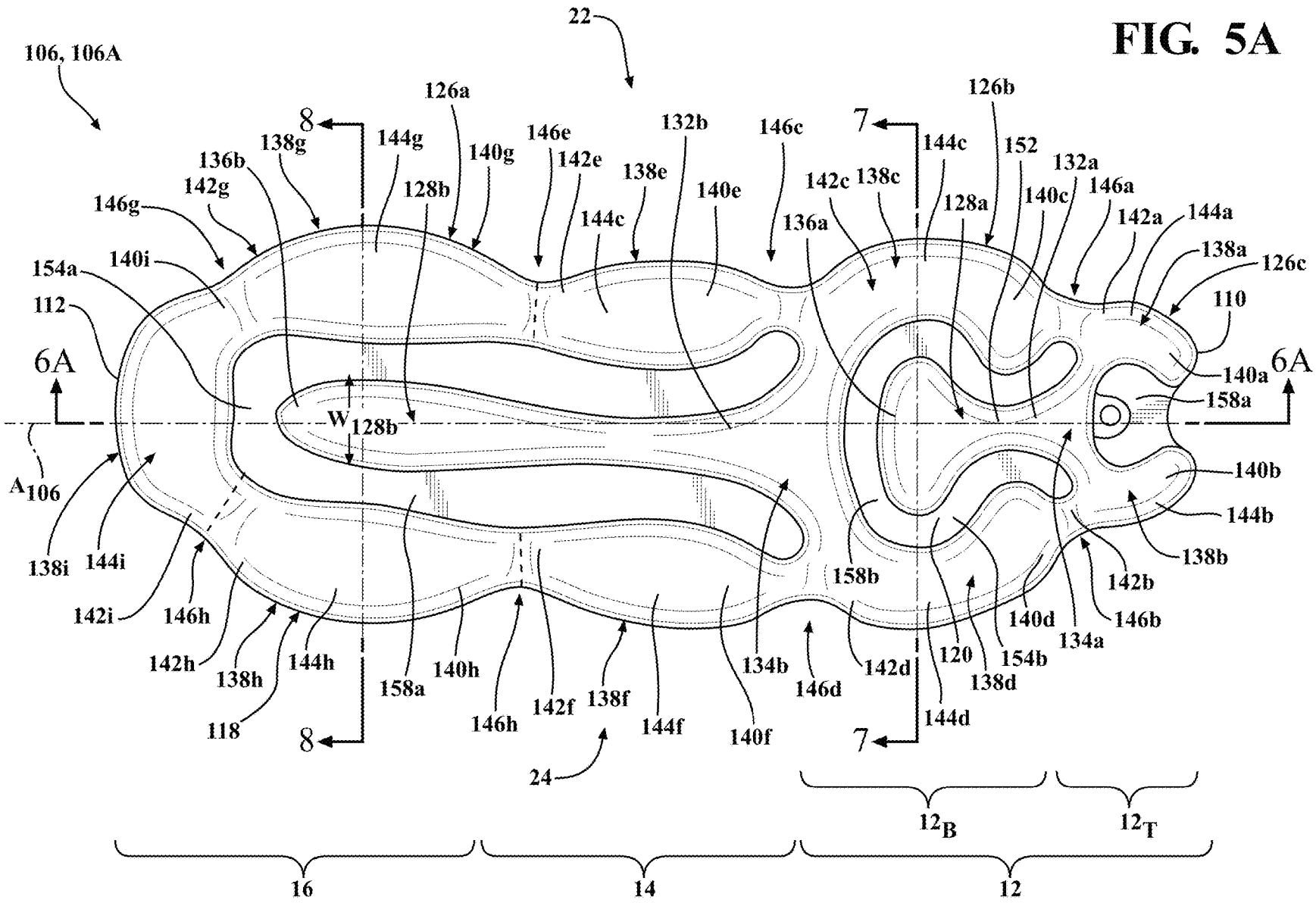
FIG. 5A is a top plan view of the cushion of FIG. 3
Figure 5B:
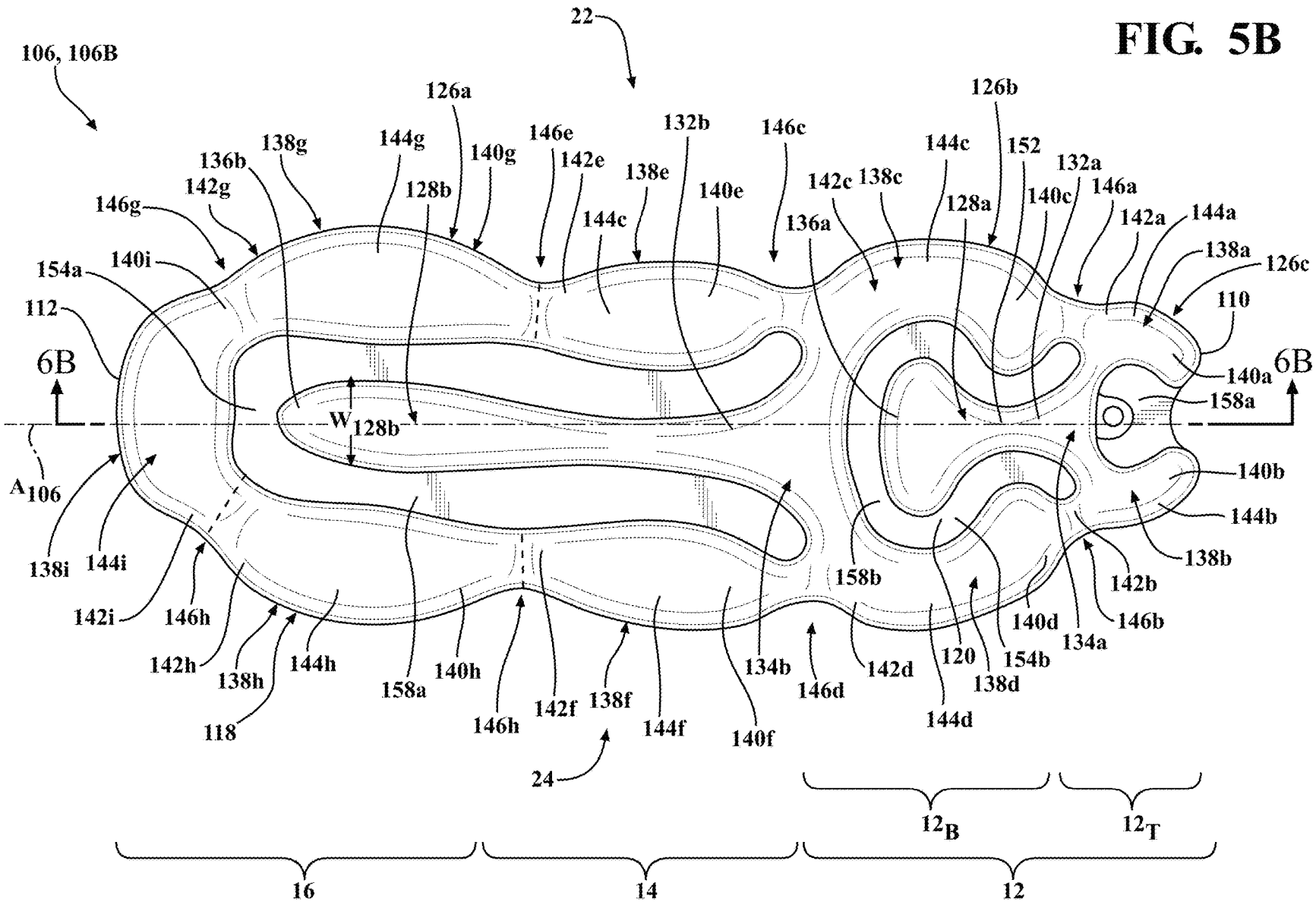
FIG. 5B is a top plan view of another aspect of a cushion for use in the sole structure of FIG. 1.
Figure 6B:
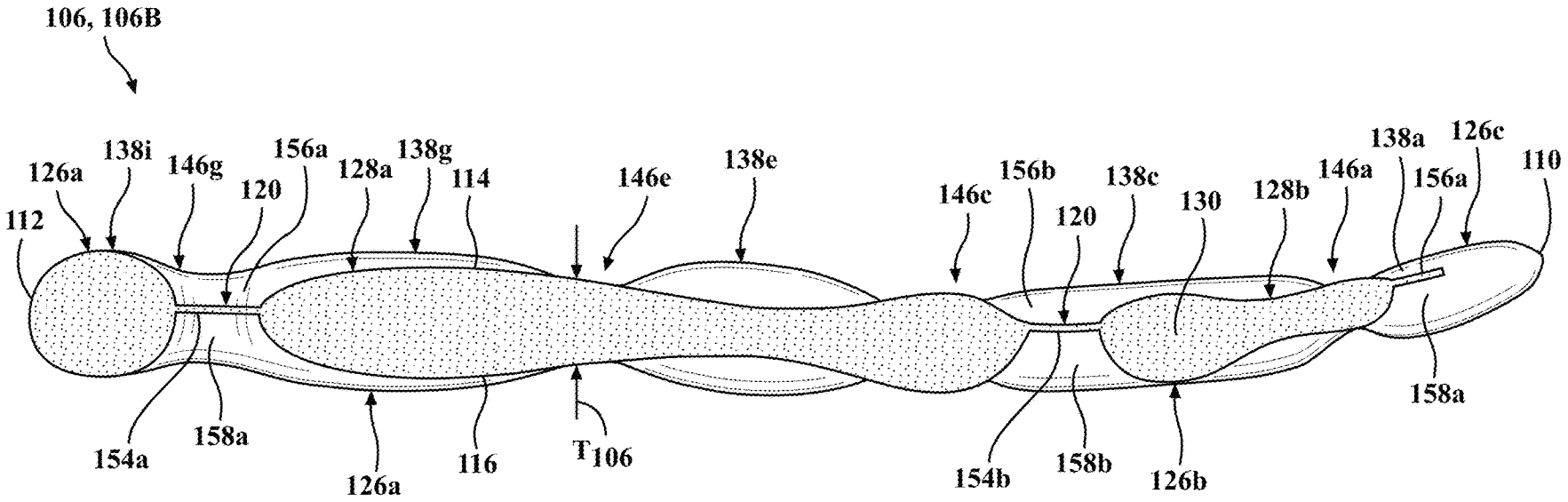
FIG. 6B is a cross-sectional view of the cushion of FIG. 5B, taken along Line 6B-6B of FIG. 5B.

With reference now to FIGS. 5B and 6B, another aspect of the cushion member 106 is provided wherein the cushion member 106 is a foam element 106B. In one aspect, the foam element 106B is a solid unitary piece extending a length, width and height of the cushion member 106. In such an aspect, the top side 114 and the bottom side 116 of the foam element 106B defines the shape of the foam element 106B. The foam element 106B comprises a foam material comprising one or more polymers. As shown in FIGS. 5B and 6B, the shape of the foam element 106B is the same as the shape of the cushion member 106 shown throughout the figures. In other words, the foam element 106B may comprise or consist essentially of a foam material having a shape that is identical to the shape defined by the barrier membranes 118 shown in FIGS. 5A and 6A. It should be noted that foam element 106B may have the same shape as the peripheral chambers 126*a*-126*c* and interior chambers 128*a*, 128*b* described with respect to the fluid-filled bladder 106A, but does not enclose a space or define an inner void, as the foam element 106B is formed as a unitary piece. Features such as the web area 120 of the fluid-filled bladder 106A are also formed of a resilient polymeric material when the cushion 106 is formed as a foam element 106B. The polymeric material may be formed to provide substantially the same cushioning and load bearing characteristics as the fluid-filled bladder 106A shown in FIGS. 5A and 6A; however, the ground-reacting forces may be different, as described above. Namely, the ground-reacting forces are primarily dissipated by the foam element 106B as opposed to being distributed throughout the fluid-filled bladder 106A. As such, an applied load is generally absorbed rather than dissipated or otherwise attenuated to other locations of the cushion member 106.

Figure 5C:
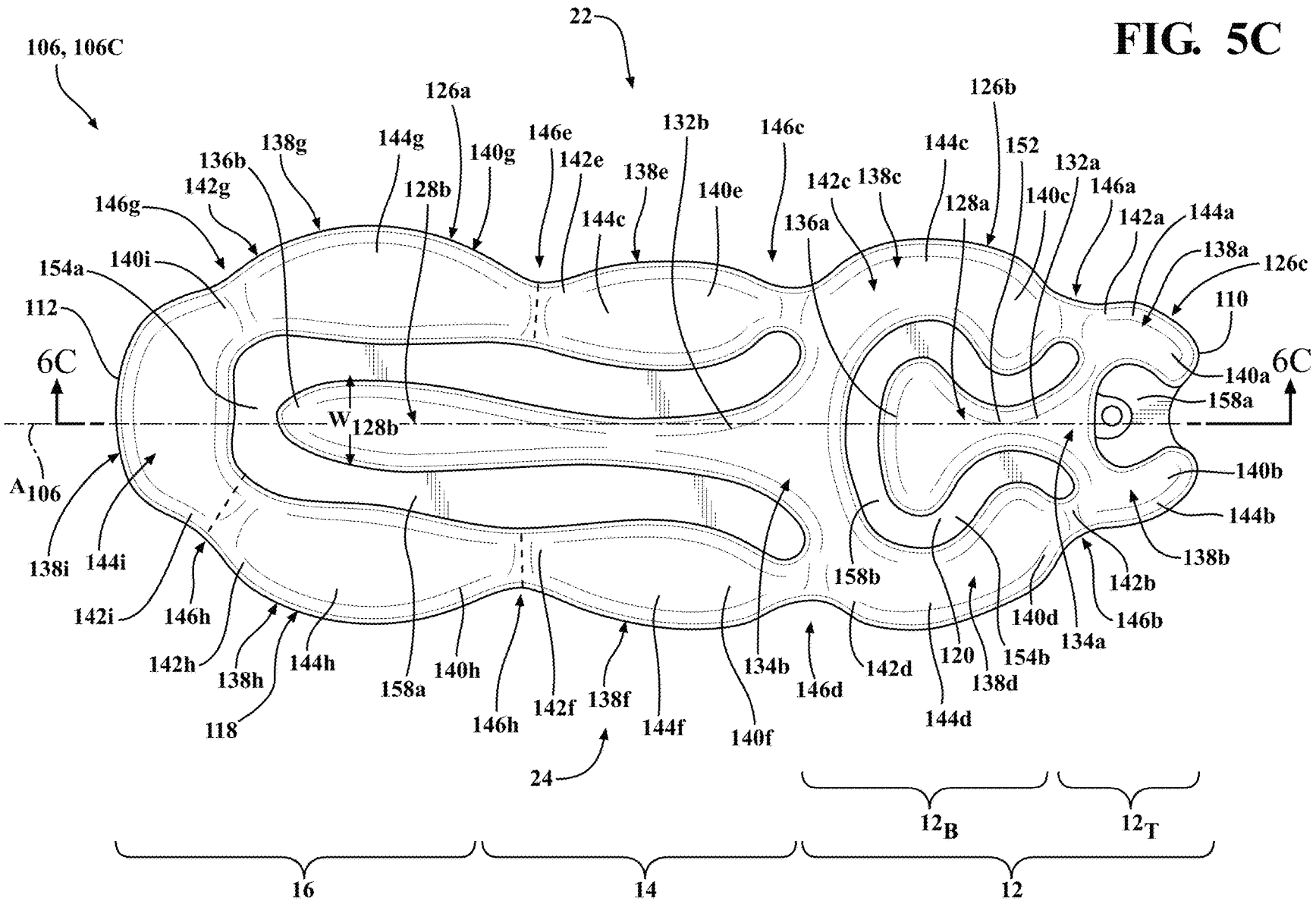
FIG. 5C is a top plan view of yet another aspect of a cushion for use in the sole structure of FIG. 1.
Figure 6C:
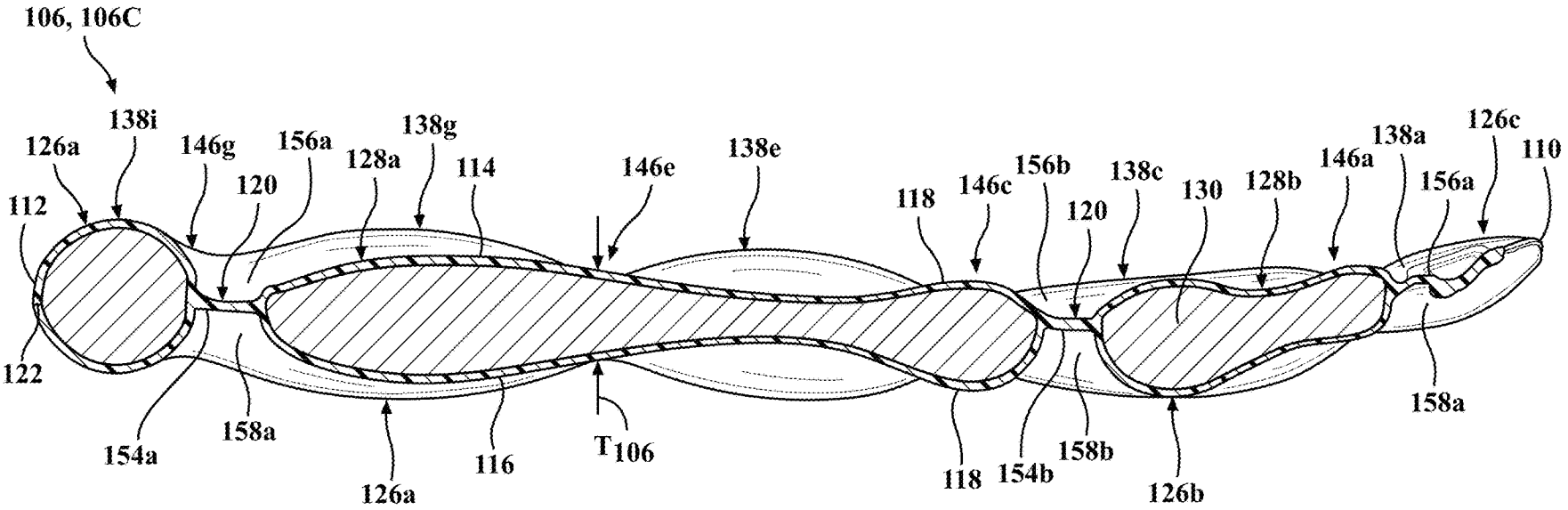
FIG. 6C is a cross-sectional view of the cushion of FIG. 5C, taken along Line 6C-6C of FIG. 5B.

With reference now to FIGS. 5C and 6C, another aspect of the cushion member 106 is provided wherein the cushion member 106 includes a foam element 106B formed as a solid body of resilient polymeric material received within and between the barrier layers 118 so as to be encapsulated. The polymeric material and associated barrier layers 118 may be formed to provide substantially the same cushioning and load bearing characteristics as the fluid-filled bladder 106A shown in FIGS. 5A and 6A; however, the ground-reacting forces are different due to the foam element 106B disposed therein. In essence, the combination of the barrier layers 118 and encapsulated foam element 106B provides a hybrid cushion that shares properties of the fluid-filled bladder 106A and the foam element 106B. Namely, an applied load will (i) cause displacement of fluid trapped between the barrier layers 118 and (ii) be absorbed by the polymeric material of the foam element 106B. Encapsulating the polymeric material within the barrier layers 118 helps keep the polymeric material of the foam element 106B clean and dry and helps the foam element 106B retain a desired shape. Regardless of whether the cushion member 106 includes barrier layers 118 and a polymeric material or just a polymeric material defining the cushion member 106, the thickness $T_{106}$ of the cushion member 106 shown in FIG. 6C is the same as the thickness $T_{106}$ of the cushion member 106 shown in FIGS. 6A and 6B. Accordingly, a discussion of the details of the cushion member 106 applies to an aspect where the cushion member 106 is a fluid-filled chamber, the cushion member 106 is formed entirely of one or more resilient polymeric materials, or is formed of one or more resilient polymeric materials encapsulated within barrier layers 118.

The cushion 106 may include a plurality of U-shaped or horseshoe-shaped chambers 126*a*-126*c* such as shown in Chan et al., U.S. patent application Ser. No. 17/133,732, the disclosure of which is incorporated by reference in its entirety. As discussed in greater detail below, portions of these chambers 126*a*-126*c* extend along the medial and lateral sides 22, 24 in the peripheral region 28. Accordingly, these chambers 126*a*-126*c* may be referred to as peripheral chambers 126*a*-126*c*. The peripheral chambers 126*a*-126*c* include a heel peripheral chamber 126*a*, a forefoot peripheral chamber 126*b*, and a toe peripheral chamber 126*c*. Generally, the peripheral chambers 126*a*-126*c* are arranged in series along the longitudinal axis A106 from the first end 110 of the cushion 106 to the second end 112 of the cushion 106. Accordingly, the chambers 126*a*-126*c* are aligned with each other along the direction of the length of the cushion 106.

Figure 3:
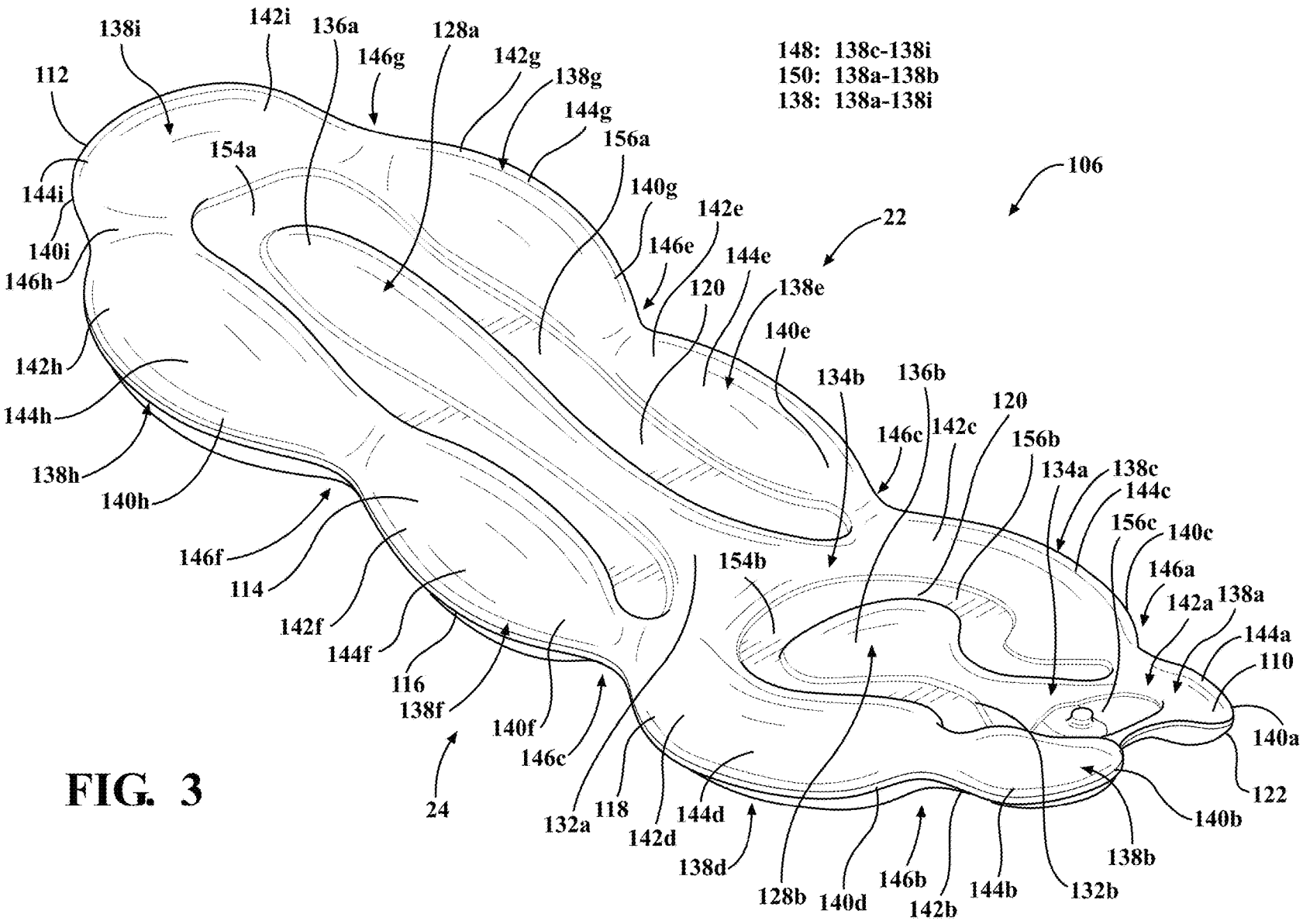
FIG. 3 is a top perspective view of a first aspect of a cushion for use in the sole structure of FIG. 1.
Figure 4:
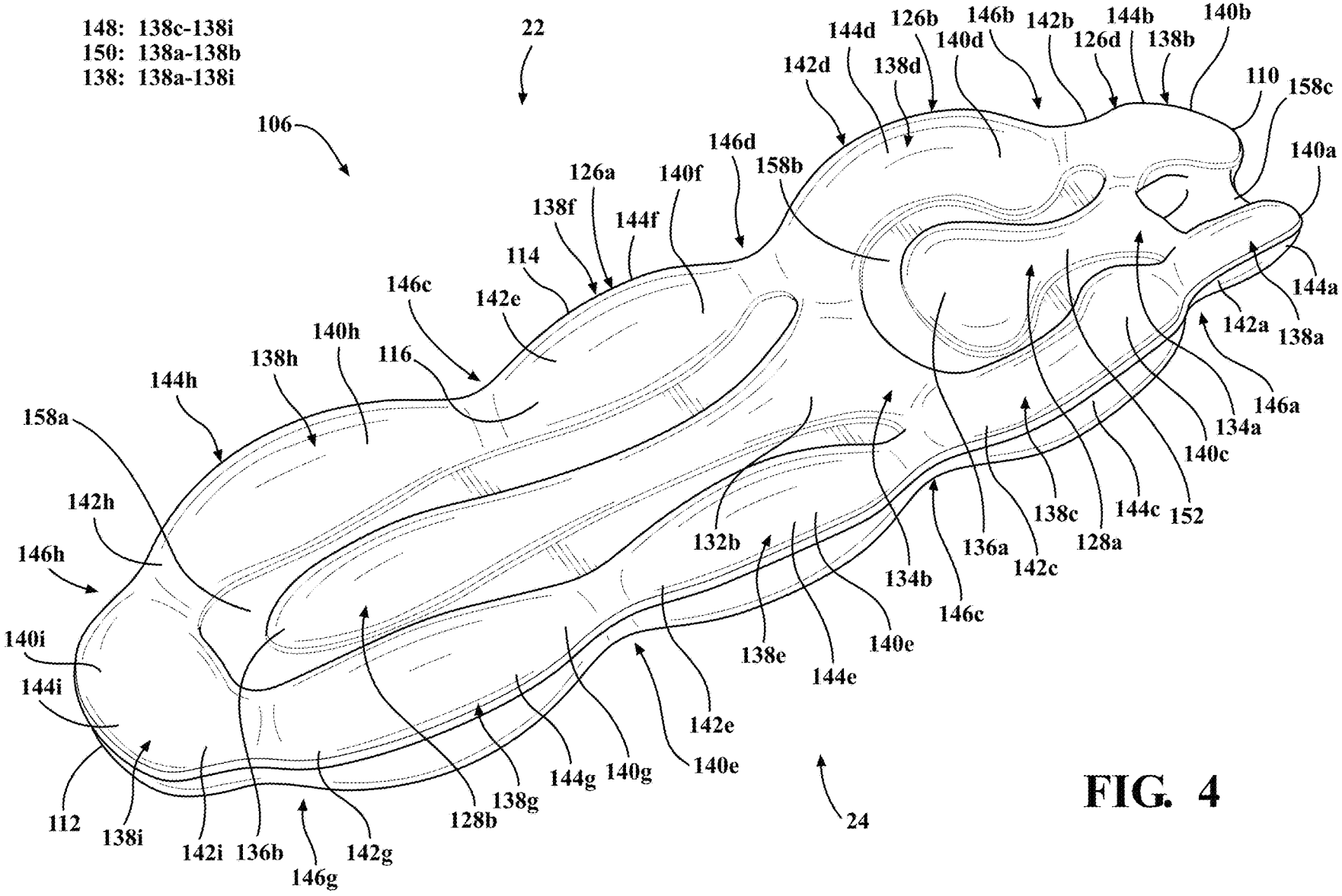
FIG. 4 is a bottom perspective view of the cushion of FIG. 3.

With reference to FIGS. 3-5, one or more of the peripheral chambers 126*a*-126*c* may have a variable cross-sectional area from end to end. In addition to the peripheral chambers 126*a*-126*c*, the cushion 106 includes one or more interior chambers 128*a*, 128*b* disposed in the interior region 26 of the cushion 106. Here, each of the interior chambers 128*a*, 128*b* is at least partially surrounded by a respective one of the peripheral chambers 126*a*, 126*b*. The peripheral chambers 126*a*-126*c* and the interior chambers 128*a*, 128*b* bound an interior void 130. Generally, each of the interior chambers 128*a*, 128*b* extends from a first end 132*a*, 132*b* connected to an intermediate segment 134*a*, 134*b* of an adjacent one of the peripheral chambers 126*b*, 126*c*, to a terminal second end 136*a*, 136*b* adjacent to the posterior end 20 of the respective one of the peripheral chambers 126*a*, 126*b*. The intermediate segments 134*a*, 134*b* fluidly couple the medial side 22 of the cushion 106 to the lateral side 24 of the cushion 106.

As shown, the heel peripheral chamber 126*a*, the forefoot peripheral chamber 126*b* and the toe peripheral chamber 126*c* include a series of lobes 138*a*-138*i* that are interconnected to each other and are disposed along the periphery of the cushion 106. The series of lobes 138*a*-138*i* extend in a direction along the longitudinal axis A106 of the cushion 106. Each of the lobes 138*a*-138*i* has a variable cross-sectional area so as to taper from a midpoint of the respective lobe 138*a*-138*i* to the ends of the respective lobes 138*a*-138*i*. For example, each of the lobes 138*a*-138*i* includes a first end 140*a*-140*i* having a first cross-sectional area, a second end 142*a*-142*i* having a second cross-sectional area, and an intermediate portion 144*a*-144*i* disposed between the first end 140*a*-140*i* and the second end 142*a*-142*i* and having a third cross-sectional area that is greater than the first cross-sectional area and the second cross-sectional area. Accordingly, each of the lobes 138*a*-138*i* tapers towards the respective first end 140*a*-140*i* and second end 142*a*-142*i* from the intermediate portion 144*a*-144*i* so as to define a first series of recesses 146*a*-146*h*, wherein each recess 146*a*-146*h* is disposed between a pair of adjacent lobes 138*a*-138*i* so as to alternate with the series of lobes 138*a*-138*i* along the length of the chambers 126*a*-126*c*. In some examples, both the width and the thickness of each of the lobes 138*a*-138*i* tapers from the intermediate portion 144*a*-144*i*.

In the illustrated example of the cushion 106, the plurality of the lobes 138*a*-138*i* are arranged end-to-end in series along the peripheral region 28 such that the cross-sectional area of the heel peripheral chamber 126*a* alternates between larger and smaller sizes. As shown, the series of lobes 138*a*-138*i* includes a first pair of toe lobes 138*a*, 138*b* disposed on the toe peripheral chamber 126*c*, a pair of forefoot lobes 138*c*, 138*d* disposed on the forefoot peripheral chamber 126*b*, a pair of mid-foot lobes 138*e*, 138*f* disposed in the mid-foot region 14 at an anterior end of the heel peripheral chamber 126*a*, a pair of heel lobes 138*g*, 138*h* disposed in the heel region 16 between the mid-foot lobes 138*e*, 138*f* and the second end 112, and a posterior lobe 138*i* disposed at the second end 112 of the cushion 106. The mid-foot lobes 138*e*, 138*f*, the heel lobes 138*g*, 138*h*, and the posterior lobe 138*i* define a first series 148 of lobes 138*e*-138*i* that form the heel peripheral chamber 126*a*. The pair of toe lobes 138*a*, 138*b* define a second series 150 of lobes 138*a*-138*b*, wherein the pair of toe lobes 138*a*, 138*b* are spaced apart from each other to define a generally U-shaped recess as viewed along a plane defined by a width and length of the chassis 108.

The mid-foot lobes 138*e*, 138*f* of the heel peripheral chamber 126*a* include a medial mid-foot lobe 138*e* disposed at the anterior end of the heel region 16 on the medial side 22 of the cushion 106, and a lateral mid-foot lobe 138*f* disposed at the anterior end of heel region 16 on the lateral side 24 of the cushion 106. Each of the medial mid-foot lobe 138*e* and the lateral mid-foot lobe 138*f* extends from a respective first end 140*e*, 140*f* and along the peripheral region 28 to its respective second end 142*e*, 142*f*.

With continued reference to FIGS. 3-5, the posterior lobe 138*i* is disposed at the second end 112 of the cushion 106 and the intermediate portion 144*i* of the posterior lobe 138*i* is aligned with the longitudinal axis A106 of the cushion 106. In the illustrated example, the posterior lobe 138*i* extends from a first end 140*i* on the medial side 22 of the cushion 106 to a second end 142*i* on the lateral side 24 of the cushion 106. As discussed above, the intermediate portion 144*i* has a greater cross-sectional area than each of the first end 140*i* and the second end 142*i*.

The heel lobes 138*g*, 138*h* of the heel peripheral chamber 126*a* include a medial heel lobe 138*g* disposed on the medial side 22 of the cushion 106, and a lateral heel lobe 138*h* disposed on the lateral side 24 of the cushion 106. As shown, first ends 140*g*, 140*h* of the heel lobes 138*g*, 138*h* are connected to the second ends 142*e*, 142*f* of the medial and lateral mid-foot lobes 138*e*, 138*f*, respectively. The second end 142*g* of the medial heel lobe 138*g* is connected to the first end 140*i* of the posterior lobe 138*i*. Likewise, the second end 142*f* of the lateral heel lobe 138*h* is connected to the second end 142*i* of the posterior lobe 138*i*. Similar to the mid-foot lobes 138*e*, 138*f* and the posterior lobe 138*i*, the heel lobes 138*e*-138*h*, provide the heel peripheral chamber 126*a* with protruding portions along the medial and lateral sides 22, 24 of the cushion 106.

With continued reference to FIGS. 3-5, the posterior lobe 138*i* is disposed at the second end 112 of the cushion 106 and the intermediate portion 144*i* of the posterior lobe 138*i* is aligned with the longitudinal axis A106 of the cushion 106. In the illustrated example, the posterior lobe 138*i* extends from a first end 140*i* on the medial side 22 of the cushion 106 to a second end 142*i* on the lateral side 24 of the cushion 106. As discussed above, the intermediate portion 144*i* has a greater cross-sectional area than each of the ends 140*i*, 142*i*.

The heel lobes 138*g*, 138*h* of the heel peripheral chamber 126*a* include a medial heel lobe 138*g* disposed on the medial side 22 of the cushion 106, and a lateral heel lobe 138*h* disposed on the lateral side 24 of the cushion 106. As shown, first ends 140*g*, 140*h* of the heel lobes 138*g*, 138*h* are connected to the second ends 142*e*, 142*f* of the medial and lateral mid-foot lobes 138*e*, 138*f*, respectively. The second end 142*g* of the medial heel lobe 138*g* is connected to the first end 140*i* of the posterior lobe 138*i*. Likewise, the second end 142*h* of the lateral heel lobe 138*h* is connected to the second end 142*i* of the posterior lobe 138*i*. Similar to the mid-foot lobes 138*e*, 138*f* and the posterior lobe 138*i*, the heel lobes 138*g*, 138*h* provide the heel peripheral chamber 126*a* with protruding portions along the medial and lateral sides 22, 24 of the cushion 106.

The intermediate segments 134*a*, 134*b* extend across the width of the cushion 106. The intermediate segment 134*b* is adjacent to the mid-foot region 14 and connects the pair of forefoot lobes 138*c*, 138*d* to each other. As shown, the intermediate segment 134*b* extends along an arcuate path from the medial side 22 to the lateral side 24. Intermediate segment 134*a* separates the toe portion 12T from the mid-foot region 14 and connects the second ends 142*a*, 142*b* of the pair of toe lobes 138*a*, 138*b* to each other. As shown, the intermediate segment 134*a* extends along an arcuate path from the medial side 22 to the lateral side 24 so as to help form a U-shaped recess between the pair of toe lobes 138*a*, 138*b*.

Referring still to FIGS. 3-5B, the forefoot peripheral chamber 126*b* includes the pair of forefoot lobes 138*c*, 138*d* that extend through the ball portion 12B of the forefoot region 12, and are disposed between the heel peripheral chamber 126*a* and the toe peripheral chamber 126*c*. Specifically, the forefoot lobes 138*c*, 138*d* include a medial forefoot lobe 138*c* and a lateral forefoot lobe 138*d*. A first recess 146*a* is formed where the second end 142*a* of the medial toe lobe 138*a* joins with the first end 140*c* of the medial forefoot lobe 138*c*. Likewise, a second recess 146*b* is formed where the second end 142*b* of the lateral toe lobe 138*b* joins with the first end 140*d* of the lateral forefoot lobe 138*d*. A third recess 146*c* is formed where the second end 142*c* of the medial forefoot lobe 138*c* joins with the first end 140*e* of the medial mid-foot lobe 138*e*. Likewise, a fourth recess 146*d* is formed where the second end 142*d* of the lateral forefoot lobe 138*d* joins with the first end 140*f* of the lateral mid-foot lobe 138*f*.

In some examples, one or both of the forefoot lobes 138*c*, 138*d* of the forefoot peripheral chamber 126*b* may be bulbous, whereby a size (e.g., cross-section, width, thickness) of the intermediate portion 144*c*, 144*d* is greater than the first end 140*c*, 140*d* and the second end 142*c*, 142*d*. For example, in the illustrated configuration, a width of each of the first ends 140*c*, 140*d* and the second ends 142*c*, 142*d* increases from the respective intermediate portion 144*c*, 144*d* such that the first ends 140*c*, 140*d* and the second ends 142*c*, 142*d* converge inwardly towards the longitudinal axis A106 of the cushion 106. With continued reference to FIGS. 3-5, one or both of the toe lobes 138*a*, 138*b* of the toe peripheral chamber 126*c* may be bulbous, whereby a size (e.g., cross-section, width, thickness) of the intermediate portion 144*a*, 144*b* is greater than the first end 140*a*, 140*b* and the second end 142*a*, 142*b*.

Unlike the heel peripheral chamber 126*a* and the forefoot peripheral chamber 126*b*, which are fully attached to the web area 120, the toe peripheral chamber 126*c* may only be partially attached to the web area 120. For example, the toe lobes 138*a*, 138*b* of the toe peripheral chamber 126*c* may project beyond the web area 120, such that each of the distal ends of the toe lobes 138*a*, 138*b* is free-hanging. Accordingly, each of the toe lobes 138*a*, 138*b* may move independent of the other. In another configuration, the toe lobes 138*a*, 138*b* of the toe peripheral chamber 126*c* may be formed to have a substantially circular shape (not shown).

As shown in FIGS. 5A and 5B, a forefoot interior chamber 128*a* extends along the longitudinal axis A106 from a first end 132*a* connected to the intermediate segment 134*a* of the toe peripheral chamber 126*c*, to a terminal second end 136*a* adjacent to the intermediate segment 134*b* of the forefoot peripheral chamber 126*b*. As shown, an outer perimeter of the forefoot interior chamber 128*a* is inwardly offset from an inner perimeter of the forefoot peripheral chamber 126*b* by a substantially constant distance. In the illustrated example, the forefoot interior chamber 128*a* includes a necked portion 152 adjacent to the first end 132*a*, which extends between the recesses 146*a*, 146*b* of the forefoot peripheral chamber 126*b*. The second end 136*a* of the forefoot interior chamber 128*a* may also be bulbous, and is circumscribed by the forefoot lobes 138*c*, 138*d* of the forefoot peripheral chamber 126*b*.

A heel interior chamber 128*b* extends along the longitudinal axis A106 from a first end 132*b* connected to the intermediate segment 134*b* of the forefoot peripheral chamber 126*b*, to a terminal second end 136*b* adjacent to the posterior lobe 138*i* of the heel peripheral chamber 126*a*. An outer perimeter of the heel interior chamber 128*b* is inwardly offset from an inner perimeter of the heel peripheral chamber 126*a* by a substantially constant distance. As such, a width of the heel interior chamber 128*b* may increase along the direction from the first end 132*b* to the second end 136*b*.

The interior chambers 128*a*, 128*b* are attached to the respective peripheral chambers 126*a*, 126*b* by the web area 120, such that each of the interior chambers 128*a*, 128*b* is surrounded by a portion the web area 120. Accordingly, the web area 120 includes a first portion 154*a* having a substantially U-shape surrounding the heel interior chamber 128*a*, and a second portion 154*b* having a substantially U-shape surrounding the forefoot interior chamber 128*b*. As shown, the first U-shaped portion 154*a* of the web area 120 extends between and attaches the outer perimeter of the heel interior chamber 128*a* and the inner perimeter of the heel perimeter chamber 126*a*. Likewise, the second U-shaped portion 154*b* extends between and attaches the outer perimeter of the forefoot interior chamber 128*b* and the inner perimeter of the forefoot peripheral chamber 126*b*. As illustrated, with respect to the aforementioned portions of the web area 120, the term "U-shaped" is not limited strictly to shapes having two straight legs connected by a constant curvature, but instead refers to any shape the extends from a first end along a general first direction, and then turns back and extends along the first direction to a second end adjacent to or across from the first end. Thus, the U-shaped portions of the web area could also be described as being horseshoe-shaped, bell-shaped, or hairpin-shaped, for example.

Adjacent ones of the chambers 126*a*-126*c*, 128*a*-128*b* are separated from each other by the portions of the web area 120, such that pockets or spaces 156*a*-156*c*, 158*a*-158*c* are formed on opposite sides 114, 116 of the cushion 106 between adjacent ones of the chambers 126*a*-126*c*, 128*a*-128*b*, as best shown in FIGS. 6A-8. In other words, the cushion 106 includes a series of upper pockets 156*a*-156*c* formed by the web area 120 and adjacent chambers 126*a*-126*c*, 128*a*-128*b* on the top side 114 of the cushion 106, and a series of lower pockets 158*a*-158*c* are formed by the web area 120 and adjacent chambers 126*a*-126*c*, 128*a*-128*b* on the bottom side 116 of the cushion 106. As shown in FIGS. 5A-5C and 10, respective pairs of the pockets or spaces 158*a*, 158*b* of the first portion 154*a* and the second portion 154*b* of the web area 120 may flare out from one another at distal ends thereof. For example, distal ends of the first portion 154*a* located proximate to the intermediate segment 134*b* may extend in directions away from one another such that the distal ends are divergent. As such, one of the distal ends of the first portion 154*a* may extend in a direction toward the medial side 22 and the other of the distal ends of the first portion 154*a* may extend in a direction toward the lateral side 24. Similarly, distal ends of the second portion 145*b* are divergent in an area proximate to the intermediate segment 134*a*.

With continued reference to FIGS. 5A and 5B, the first and second ends 140*a*-140*i*, 142*a*-142*i* of the series of lobes 138*a*-138*i* and the first ends 132*a*, 132*b* of the interior chambers 128*a*, 128*b* form a plurality of conduits fluidly coupling adjacent ones of the peripheral chambers 126*a*-126*c* to each other. Accordingly, the portions of the interior void 130 formed by each of the peripheral chambers 126*a*-126*c* and the interior chambers 128*a*, 128*b* are in fluid communication with each other, such that fluid can be transferred between the peripheral chambers 126*a*-126*c*.

With continued reference to FIGS. 2A and 2B, the chassis 108 is configured to interface with the cushion 106 to provide a unitary midsole 102. The chassis 108 extends from a first end 160 at the anterior end 18 of the sole structure 100 to a second end 162 at the posterior end 20 of the sole structure 100. The chassis 108 further includes a top surface 164 defining a portion of a footbed, and a bottom surface 166 formed on the opposite side of the chassis 108 than the top surface 164 and configured to interface with the top side 114 of the cushion 106.

The chassis 108 may be formed as a unitary piece, or may be formed of a plurality of elements as discussed in greater detail below. The chassis 108 includes a series of supports 168*a*-168*g* extending along a length of the chassis 108. In particular, a plurality of medial supports 168*a*, 168*c*, 168*e* and 168*g* extends along a medial side 22 of the chassis 108, a plurality of lateral supports 168*b*, 168*d*, 168*f* and 168*h* extends along a lateral side 24 of the chassis 108, and a posterior support 168*i* is disposed at the posterior end 20 of the chassis 108. The posterior support 168*i* is disposed between the series of lateral supports 168*a*, 168*c*, and 168*e* and the series of medial supports 168*b*, 168*d* and 168*f*. The series of supports 168*a*-168*i* alternate with a series of recesses 170*a*-170*f*, which also extends along the length of the chassis 108. In particular, medial recesses 170*a*, 170*c* and 170*e* of the second series of recesses 170*a*-170*f* extend along the medial side 22 of the chassis 108 and lateral recesses 170*b*, 170*d* and 170*f* of the second series of recesses 170*a*-170*f* extend along the lateral side 24 of the chassis 108.

A lateral mid-foot recess 170*c* and a medial mid-foot recess 170*d* cooperate to define a mid-foot continuous recess 172 (FIG. 11) extending the width of the chassis 108. Likewise, lateral forefoot recess 170*a* and medial forefoot recess 170*b* cooperate to define a forefoot continuous recess 174 (FIG. 11) extending the width of the chassis 108. The chassis 108 may further include a pair of inner supports 176*a*, 176*b* disposed in the forefoot region 12. Each of the inner supports 176*a*, 176*b* is illustratively shown as having a generally triangular-shaped cross-section as taken along a width of the inner supports 176*a*, 176*b*. A forefoot inner support 176*a* is formed on the bottom surface 166 of the chassis 108 and is disposed in the forefoot continuous recess 174 so as to be disposed between the lateral forefoot recess 170*a* and the medial forefoot recess 170*b*. A toe inner support 176*b* is disposed at the anterior end 18 of the chassis 108. The bottom surface 166 of the forefoot inner support 176*a* is generally concave so as to be configured to engage a top surface of the intermediate segment 134*a* of the cushion 106. Likewise, the bottom surface 166 of toe inner support 176*b* is also generally concave so as to be configured to engage a top surface of intermediate segment 134*b* of the cushion 106.

The series of supports 168*a*-168*i* are aligned and in contact with the series of lobes 138*a*-138*i*. As such, a distal end of each of the supports 168*a*-168*i* is generally concave so as to receive a top surface of a respective one of the lobes 138*a*-138*i*. The supports 168*c*-168*i* define a first series 178 of supports configured to be aligned with and contact the first series 148 of lobes 138*e*-138*i*. The supports 168*a*-168*b* define a second series 180 of supports configured to be aligned with the second series 150 of lobes 138*a*-138*b* disposed in the toe portion 12T of the forefoot region 12.

In an aspect where the chassis 108 is formed by multiple elements, the chassis 108 may include a cushion 182, a plate 184 and an insert 186, the insert 186 comprising an insert material including one or more polymers. In such an aspect, the first series 178 of supports 168*c*-168*i* are formed by the assembly of the plate 184 to the cushion 182 and the second series 180 of supports 168*a*-168*b* are formed solely by the plate 184. In such an aspect, the portions of the plate 184 and the cushion 182 collectively form the first series 178 of supports 168*c*-168*i* when assembled together and cooperate to engage the top surface of a respective first series 148 of lobes 138*a*-138*i*.

With continued reference to FIGS. 2A and 2B, the chassis 108 may be configured to support the periphery of a user's foot. In such an aspect, the chassis 108 may further include an upper portion 188*a*-188*i* disposed on at least one support of the series of supports 168*a*-168*i*. The upper portion 188*a*-188*h* is disposed along the periphery of the chassis 108 and is curved along both the width and the height of the chassis 108 so as to conform to the shape of the bottom of a foot. The upper portion 188*a*-188*i* includes a series of medial upper portions 188*a*, 188*c*, 188*e*, 188*g* and a series of lateral upper portions 188*b*, 188*d*, 188*f*, 188*h* extending along a periphery of the respective medial side 22 and lateral side 24 of the chassis 108. An upper posterior portion 188*i* is disposed on the posterior end 20 of the chassis 108 and the series of medial upper portions 188*a*, 188*c*, 188*e*, 188*g* and the series of upper lateral portions 188*b*, 188*d*, 188*f*, 188*h* are respectively arranged in series from opposite ends of the upper posterior portion 188*i*. The upper posterior portion 188*i* forms a cup for assisting in the support of the back of a heel. A height to the upper portions 188*a*-188*i* may be the same or may be varied. In aspects where the chassis 108 is formed as a unitary piece, the upper portion 188*a*-188*h* is contiguous with the series of supports 168*a*-168*i*. In aspects where the chassis 108 is formed of multiple elements, such as a cushion 182, a plate 184 and an insert 186, the upper portion 188*a*-188*h* may be defined by the plate 184.

Figure 9:
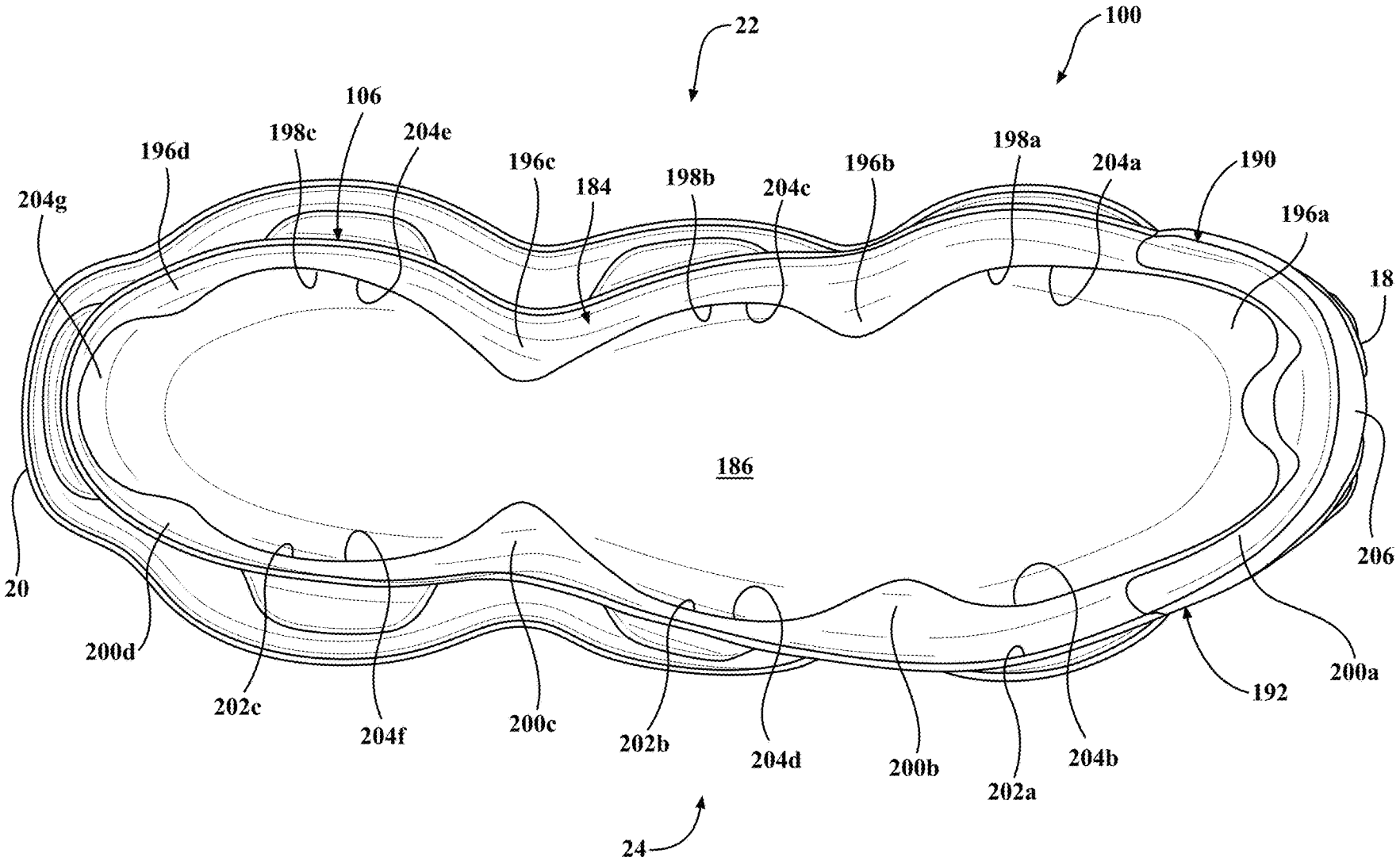
FIG. 9 is a top plan view of the sole structure of FIG. 1.

As described above, the series of first supports 178 may be formed by a combination of the cushion 182 and the plate 184. The plate 184 further includes a medial support arm 190 and a lateral support arm 192 extending from the ends of the upper posterior portion 182*i*. A distal end of each of the medial support arm 190 and lateral support arm 192 is spaced apart from each other so as to define an insert pocket 194. The medial support arm 190 includes a series of inner medial flanges 196*a*-196*d* that are spaced apart from each other so as to form a series of inward medial depressions 198*a*-198*c* alternating with a respective inner medial flange 196*a*-196*d*. Each of the inner medial flanges 196*a*-196*d* is disposed on an inner surface of the medial support arm 190 and extends towards a center of the plate 184 so as to be generally orthogonal to the upper portions 188. The lateral support arm 192 includes a series of inner lateral flanges 200*a*-200*d*. The inner lateral flanges 200*a*-200*d* are spaced apart from each other so as to form a series of inward lateral depressions 202*a*-202*d* alternating with a respective inner lateral flange 200*a*-200*c*. The inner lateral flanges 200*a*-200*d* are disposed on an inner surface of the lateral support arm 192 and extend towards a center of the plate 184. The insert pocket 194 has a shape defined by the inner medial flanges 196*a*-196*d*, inward medial depressions 198*a*-198*c*, the inner lateral flanges 200*a*-200*d* and the inward lateral depressions 200*a*-200*c* so as to fittingly receive the insert 186 as shown in FIG. 9.

With continued reference to FIGS. 2A and 2B, the insert 186 has a periphery edge configured to be seated between the medial support arm 190 and the lateral support arm 192 of the plate 184 so as to fit within the insert pocket 194. The insert 186 is a unitary body having a series of wings 204*a*-204*g* extending along the periphery of the medial side 22 and lateral side 24 of the insert 186. The wings 204*a*-204*g* are spaced apart from each other so as define a peripheral edge that is configured to be seated within the insert pocket 194. A posterior wing 204*g* is disposed on the second end 112 of the chassis 108 and is configured to be seated against a portion of the upper posterior portion 182*i* of the plate 184. The plate 184 is mounted to a top surface of the cushion 182 so as to be disposed between the upper 300 and the cushion 182. The plate 184 is longer than the cushion 182 and the lateral and medial supports 168*a*, 168*b* are formed on a bottom surface of the plate 184.

A toe cap 206 is disposed on the first end 110 of the chassis 108. The toe cap 206 may comprise the insert material, or may comprise a toe cap material including one or more polymers, where the toe cap material differs from the insert material as described above. The toe cap 206 is configured to shield the toes of the user. In one aspect, the toe cap 206 is formed as a separate piece and may be adhered to the insert 186 using any known or later developed attachment techniques to include adhesives, stitching, or the like. The toe cap 206 is a generally arcuate member extending upwardly from the body of the insert 186.

The chassis 108 includes ridges 208*a*-208*c* that are configured to be seated in a respective one of the upper pockets 156*a*-156*c* of the cushion 106 when the chassis 108 is assembled to the cushion 106. The anterior ridge 208*a* has a generally C-shaped structure configured to receive interior chamber 128*b*. The intermediate ridge 208*b* and the posterior ridge 208*c* collectively form a generally U-shaped dimension so as to define a depression 210*a*-210*c* extending longitudinally between elongated portions of the intermediate ridge 208*b* and the posterior ridge 208*c*. The depression 210*a*-210*c* is configured to receive heel interior chamber 128*b*. In the illustrated example, the ridges 208*a*-208*c* may be configured to fully extend into the web area 120 of the upper pockets 156*a*-156*c* in some areas and spaced apart from the web area 120 of the upper pockets 156*a*-156*c* in other areas when the midsole 102 is assembled. Thus, the portion of the bottom side 116 defining the ridges 208*a*-208*c* may contact the web area 120 in selected locations. In other examples, one or more of the ridges 208*a*-208*c* may be configured so that the distal ends are spaced apart from the web area 120, or may be omitted from the chassis.

Figure 10:
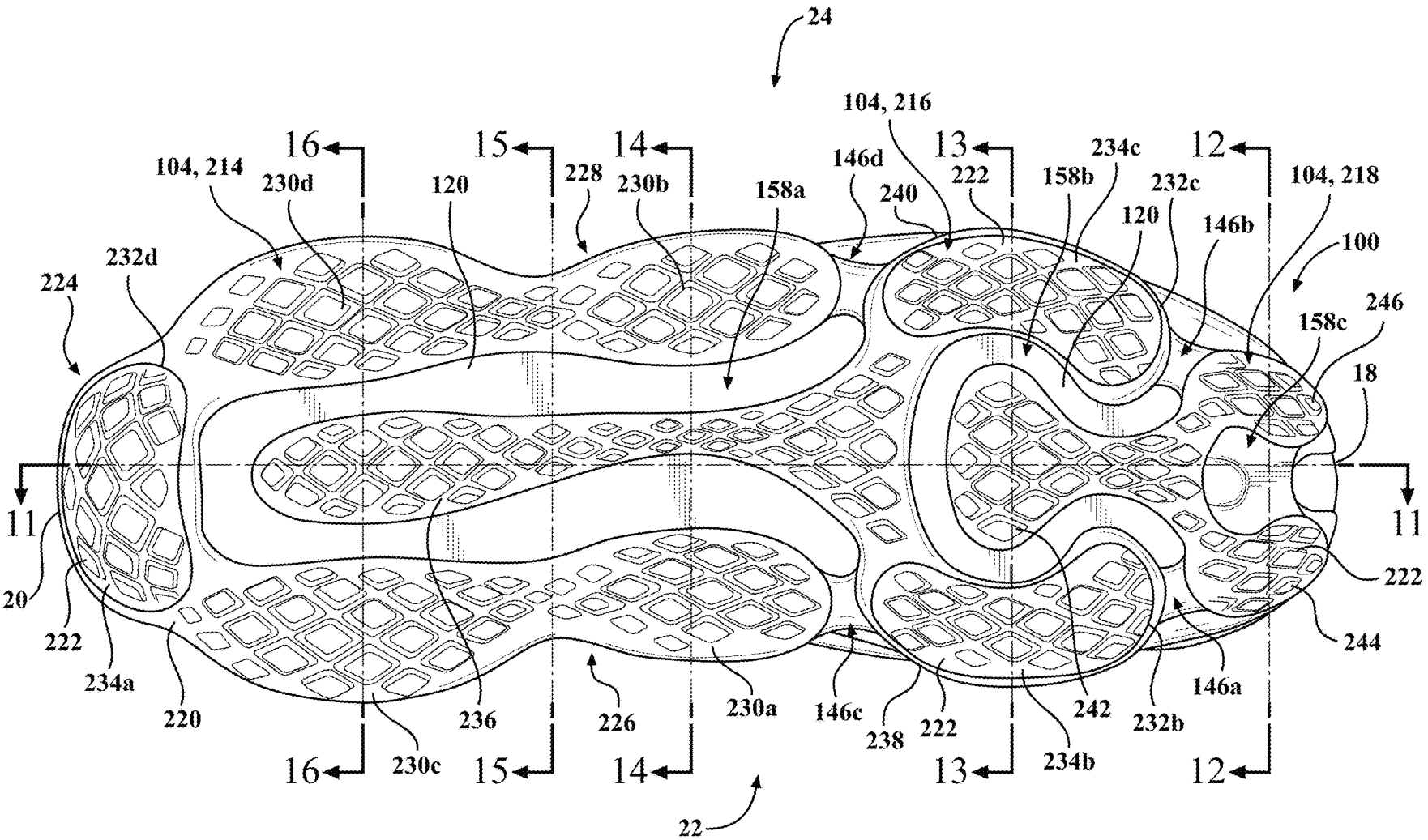
FIG. 10 is a bottom plan view of the sole structure of FIG. 1.

With reference now to FIGS. 9 and 10, an aspect of the chassis 108 is provided, wherein the chassis 108 is formed of the cushion 182, the plate 184, and the insert 186. The cushion 182, the plate 184, and the insert 186 may be secured to each other to form a unitary piece using any technique such as adhesives, welding, or the like. Alternatively, the cushion 182, the plate 184 and the insert 186 may be simply mounted to each other and held by an attachment to the outsole 104 and the upper 300.

Figure 11:
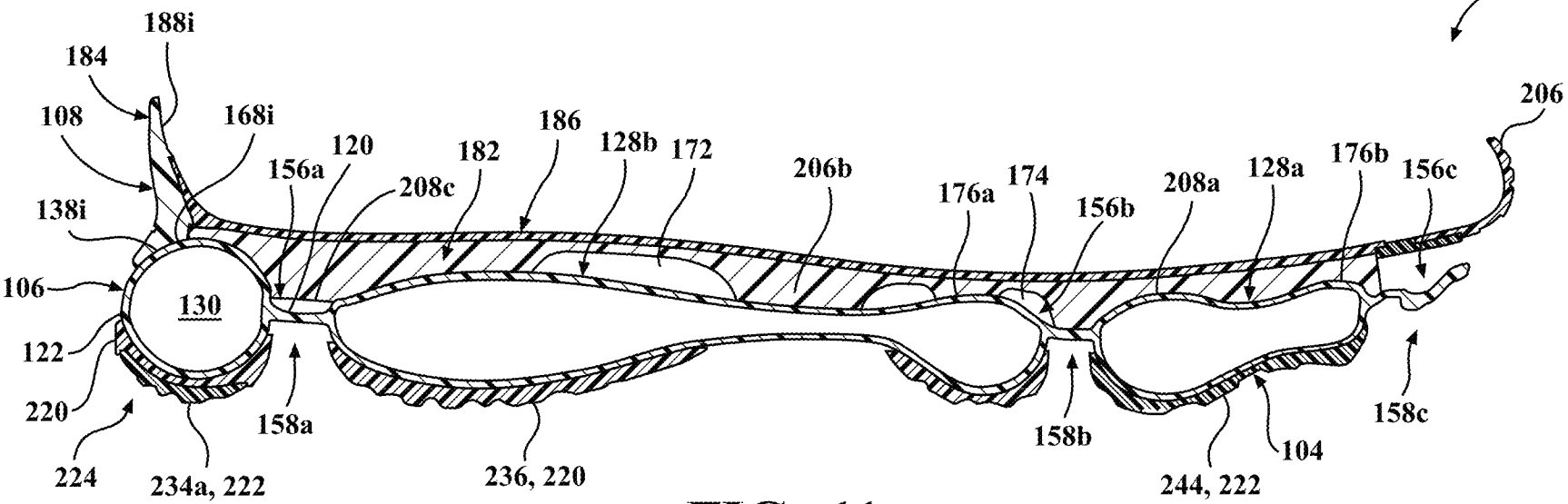
FIG. 11 is a cross-sectional view of the sole structure of FIG. 1, taken along Line 11-11 of FIG. 10.

With reference now to FIG. 11, the chassis 108 and the outsole 104 are shown assembled to the cushion 106. The ridges 208*a*-208*c* are shown contacting the web area 120. The plate 184 is longer than the cushion 182 wherein the toe cap 206 extends beyond the posterior end of the cushion 182. The outsole 104 is mounted to a bottom surface of the cushion 106 to protect the cushion 106 during engagement with a ground surface. The ridges 208*a*-208*c* have an arcuate bottom surface 166 that is configured to engage the top surface of the respective interior chambers 128*a*, 128*b*. Inner support 176*a* is seated against a top surface of forefoot interior chamber 128*a* and inner support 176*b* is seated against the top surface of the heel interior chamber 128*b*. The mid-foot continuous recess 172 and the forefoot continuous recess 174 extend across the width of the chassis 108. The mid-foot continuous recess 172 and the forefoot continuous recess 174 are positioned so as to facilitate flexing of the outsole 104.

Figure 12:
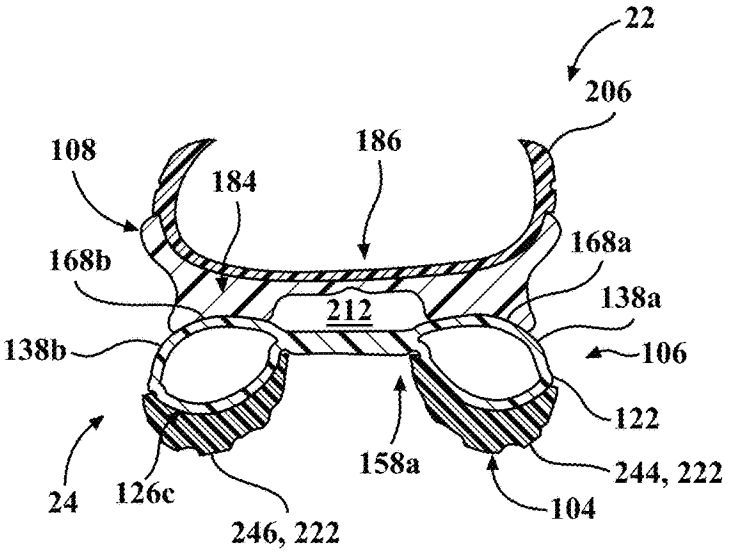
FIG. 12 is a cross-sectional view of the sole structure of FIG. 1, taken along Line 12-12 of FIG. 10.

With reference now to FIG. 12, a cross-sectional view taken along Line 12-12 of FIG. 10 is provided. FIG. 12 shows the engagement of the toe lobes 138*a*, 138*b* with the chassis 108. In such an aspect, the second series 180 of supports 168*a*-168*b* are formed fully by the plate 184. The plate 184 and insert 186 are assembled together to form a unitary piece. A top surface of the plate 184 is contiguous and generally seamless with a top surface of the insert 186 to define a profile of the footbed. The cushion 182 does not extend to the toe lobes 138*a*, 138*b*. A gap 212 is formed between the pair of toe lobes 138*a*, 138*b*. The gap 212 allows for the toe lobes 138*a*, 138*b* to flex freely relative to lobes 138*c*-138*i* which are connected at a respective first end 140*a*-140*i* and second end 142*a*-142*i*.

Figure 13:
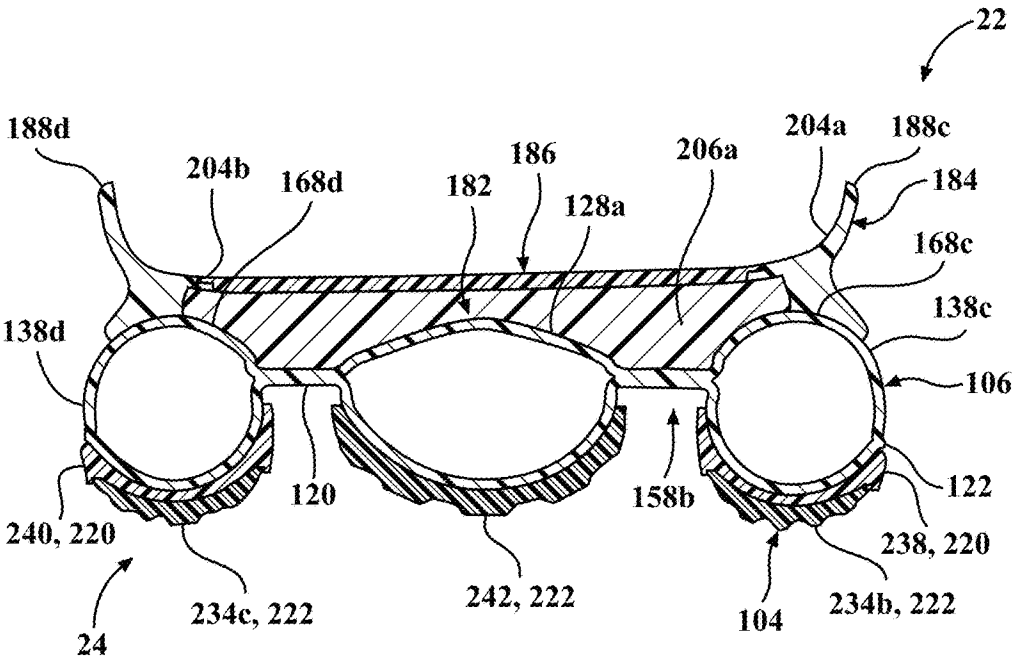
FIG. 13 is a cross-sectional view of the sole structure of FIG. 1, taken along Line 13-13 of FIG. 10.

With reference now to FIG. 13, a cross-sectional view taken along Line 13-13 of FIG. 10 is provided. The chassis 108 is fully seated against the top surface of the cushion 106. The medial support 168*c* and lateral support 168*d* are engaged with the pair of forefoot lobes 138*c*, 138*d*. The medial support 168*c* is formed by an assembly of the cushion 182 and the plate 184, wherein the cushion 182 defines an inner portion of the medial support 168*c* and the plate 184 defines an outer portion of the medial support 168*c*. Likewise, the cushion 182 defines an inner portion of the lateral support 168*d* and the plate 184 defines an outer portion of the lateral support 168*d*. The anterior ridge 208*a* is seated against the web area 120 defining upper pockets 156*b*. The area of the cushion 182 between the medial side 22 and the lateral side 24 of the anterior ridge 208*a* is arcuate so as to be seated against the top surface of the forefoot interior chamber 128*a*.

Figure 14:
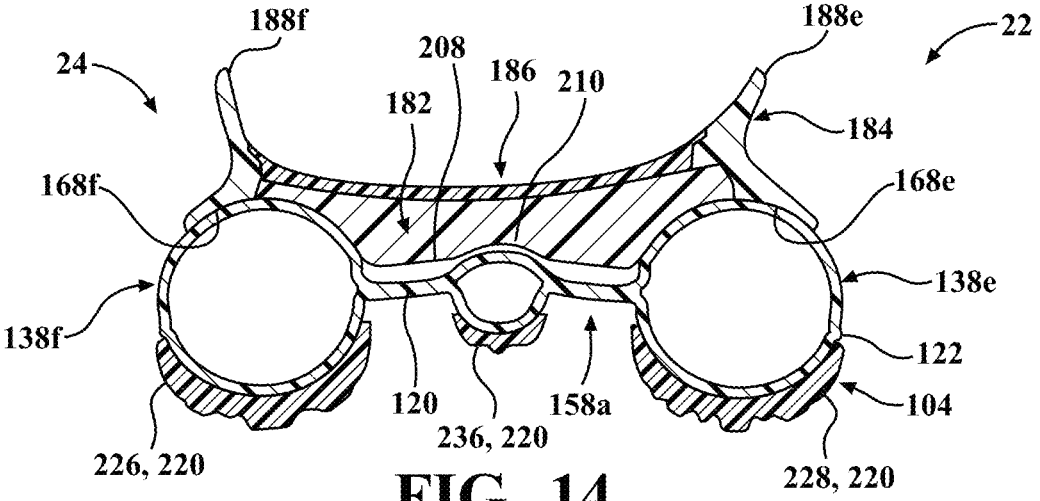
FIG. 14 is a cross-sectional view of the sole structure of FIG. 1, taken along Line 14-14 of FIG. 10.

With reference now to FIG. 14, a cross-sectional view taken along Line 14-14 of FIG. 10 is provided. The medial support 168*e* and the lateral support 168*f* are aligned with and contact a top surface of a respective one of the pair of mid-foot lobes 138*e*, 138*f*. The medial support 168*e* and the lateral support 168*f* are dimensioned to be fully seated against the respective mid-foot lobes 138*e*, 138*f*. The medial support 168*e* is formed by an assembly of the cushion 182 and the plate 184, wherein the cushion 182 defines an inner portion of the medial support 168*e* and the plate 184 defines an outer portion of the medial support 168*e*. Likewise, the cushion 182 defines an inner portion of the lateral support 168*f* and the plate 184 defines an outer portion of the lateral support 168*f*. The area of the cushion 182 between the medial side 22 and lateral side 24 of the intermediate ridge 208*b* is arcuate so as to be seated against the top surface of interior chamber 128*a*. FIG. 14 shows an aspect where the bottom surface of the intermediate ridge 208*b* is spaced apart from the web area 120.

Figure 15:
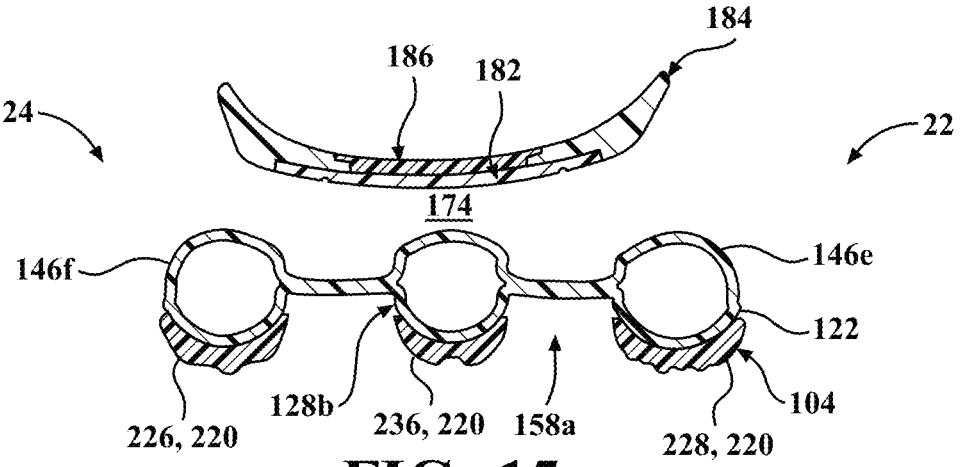
FIG. 15 is a cross-sectional view of the sole structure of FIG. 1, taken along Line 15-15 of FIG. 10.

With reference now to FIG. 15, a cross-sectional view taken along Line 15-15 of FIG. 10 is provided. The cross-sectional view is taken along the recesses 146*e*, 146*f* of the cushion 106 and the recesses 170*e*, 170*f* that form the forefoot continuous recess 174 formed on the chassis 108. Accordingly, the chassis 108 is spaced apart from the cushion 106 so as to facilitate increased flexibility about Line 15-15.

Figure 16:
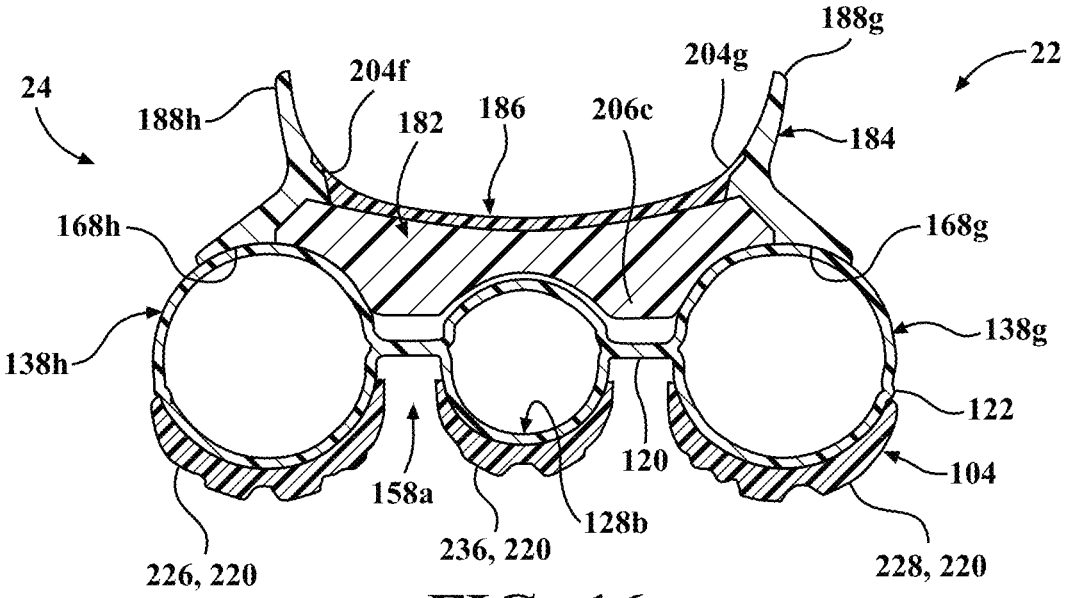
FIG. 16 is a cross-sectional view of the sole structure of FIG. 1, taken along Line 16-16 of FIG. 10.

With reference now to FIG. 16, a cross-sectional view taken along Line 16-16 of FIG. 10 is provided. The medial support 168*g* and the lateral support 168*h* are aligned with and contact a top surface of a respective one of the pair of heel lobes 138*g*, 138*h*. The medial support 168*g* and the lateral support 168*h* are dimensioned to be fully seated against the respective heel lobes 138*g*, 138*h*. The lateral support 168*h* is formed by an assembly of the cushion 182 and the plate 184, wherein the cushion 182 defines an inner portion of the lateral support 168*h* and the plate 184 defines an outer portion of the lateral support 168*h*. Likewise, the cushion 182 defines an inner portion of the medial support 168*g* and the plate 184 defines an outer portion of the medial support 168*g*. The posterior ridge 208*c* is seated within upper pocket 156*a*. The area of the cushion 182 between the medial side 22 and the lateral side 24 of the posterior ridge 208*c* is arcuate so as to be seated against the top surface of heel interior chamber 128*b*. FIG. 16 shows an aspect where the bottom surface of the posterior ridge 208*c* is spaced apart from the web area 120.

The components 182, 184, 186 of the chassis 108 may include a chassis material comprising one or more polymers, such as foam or rubber, to impart properties of cushioning, responsiveness, and energy distribution to the foot of the wearer. In the illustrated example, the cushion 182 comprises a first foam material, the plate 184 comprises a second foam material, and the insert 186 comprises a third foam material, which are substantially the same, or which differ from each other in one or more of appearance, physical properties, and composition, as described above. For example, the cushion material and the plate material may provide greater cushioning and impact distribution than the insert material, while the insert material has a greater stiffness than the cushion material and/or the plate material in order to provide increased lateral stiffness to the peripheral region 28 of the upper 300.

With reference again to FIG. 2B and FIGS. 11-16, in one aspect of the plate 184, each support in the series of supports 168*a*-168*g* extends outwardly and downwardly from a periphery of the plate 184 and the upper portion 188*a*-188*i* extends upwardly and outwardly from the periphery the plate 184. Each support in the series of supports 168*a*-168*g* is aligned with a corresponding upper portion 188*c*-188*i* so as to define a generally V-shaped cross-section. The series of supports 168*a*-168*g* and the corresponding upper portion 188*c*-188*i* cooperate with each other to provide a compressive and reactive force in response to a load. As an example, the series of supports 168*a*-168*g* and the corresponding upper portion 188*c*-188*i* function as a spring in response to a compressive load.

The chassis material comprises one or more polymers. Example chassis materials include foamed or solid materials, including molded foamed and molded solid materials.

The various materials described herein (e.g., the outsole material, the cushion material, the chassis material, etc.) comprise, consist of, or consist essentially of one or more polymers. The one or more polymers may include one or more thermoplastic polymers, one or more thermosetting or thermosettable polymers (i.e., polymers which are capable of being crosslinked, but which have not yet been crosslinked), or one or more thermoset polymers. The one or more polymers may include one or more elastomers, including thermoplastic elastomers (TPEs) or thermoset elastomers, or both. The one or more polymers may include aliphatic polymers, aromatic polymers, or mixtures of both; and may include homopolymers, copolymers (including terpolymers), or mixtures of both.

In some aspects, the one or more polymers may include olefinic homopolymers, olefinic copolymers, or blends thereof. Examples of olefinic polymers include polyethylene, polypropylene, and combinations thereof. In other aspects, the one or more polymers may include one or more ethylene copolymers, such as, ethylene-vinyl acetate (EVA) copolymers, ethylene-vinyl alcohol (EVOH) copolymers, ethylene-ethyl acrylate copolymers, ethylene-unsaturated mono-fatty acid copolymers, and combinations thereof.

In further aspects, the one or more polymers may include one or more polyacrylates, such as polyacrylic acid, esters of polyacrylic acid, polyacrylonitrile, polyacrylic acetate, polymethyl acrylate, polyethyl acrylate, polybutyl acrylate, polymethyl methacrylate, and polyvinyl acetate; including derivatives thereof, copolymers thereof, and any combinations thereof.

In yet further aspects, the one or more polymers may include one or more ionomeric polymers. In these aspects, the ionomeric polymers may include polymers with carboxylic acid functional groups, sulfonic acid functional groups, salts thereof (e.g., sodium, magnesium, potassium, etc.), and/or anhydrides thereof. For instance, the ionomeric polymer(s) may include one or more fatty acid-modified ionomeric polymers, polystyrene sulfonate, ethylene-methacrylic acid copolymers, and combinations thereof.

In further aspects, the one or more polymers may include one or more styrenic block copolymers, such as acrylonitrile butadiene styrene block copolymers, styrene acrylonitrile block copolymers, styrene ethylene butylene styrene block copolymers, styrene ethylene butadiene styrene block copolymers, styrene ethylene propylene styrene block copolymers, styrene butadiene styrene block copolymers, and combinations thereof.

In further aspects, the one or more polymers may include one or more polyamide copolymers (e.g., polyamide-polyether copolymers) and/or one or more polyurethanes (e.g., cross-linked polyurethanes and/or thermoplastic polyurethanes). Examples of suitable polyurethanes include those discussed above for barrier layers 118. Alternatively, the one or more polymers may include one or more natural and/or synthetic rubbers, such as polybutadiene and polyisoprene.

When the material is a foamed material, the foamed material may be foamed using a physical blowing agent which phase transitions to a gas based on a change in temperature and/or pressure, or a chemical blowing agent which forms a gas when heated above its activation temperature. For example, the chemical blowing agent may be an azo compound such as adodicarbonamide, sodium bicarbonate, and/or an isocyanate.

In some configurations, the foamed polymeric material may be a crosslinked foamed material. In these configurations, a peroxide-based crosslinking agent such as dicumyl peroxide may be used. Furthermore, the foamed polymeric material may include one or more fillers such as pigments, modified or natural clays, modified or unmodified synthetic clays, talc glass fiber, powdered glass, modified or natural silica, calcium carbonate, mica, paper, wood chips, and the like.

The material may be formed using a molding process. In one example, when the material includes a molded elastomer, the uncured material (e.g., uncured rubber) may be mixed in a Banbury mixer with an optional filler and a curing package such as a sulfur-based or peroxide-based curing package, calendared, formed into shape, placed in a mold, and vulcanized.

In another example, when the material is a foamed material, the material may be foamed during a molding process, such as an injection molding process. A thermoplastic material may be melted in the barrel of an injection molding system and combined with a physical or chemical blowing agent and optionally a crosslinking agent, and then injected into a mold under conditions which activate the blowing agent, forming a molded foam.

Optionally, when the material is a foamed material, the foamed material may be a compression molded foam. Compression molding may be used to alter the physical properties (e.g., density, stiffness and/or durometer) of a foam, or to alter the physical appearance of the foam (e.g., to fuse two or more pieces of foam, to shape the foam, etc.), or both.

The compression molding process desirably starts by forming one or more foam preforms, such as by injection molding and foaming a material, by forming foamed particles or beads by foaming a material, by cutting foamed sheet stock, and the like. The compression molded foam may then be made by placing the one or more foam preforms in a compression mold, and applying sufficient pressure to the one or more foam preforms to compress the one or more foam preforms in a closed mold. Once the mold is closed, sufficient heat and/or pressure is applied to the one or more foam preforms in the closed mold for a sufficient duration of time to alter the foam preform(s) by forming a skin on the outer surface of the compression molded foam, or fusing individual foam particles to each other, or increasing the density of the foam(s) which is retained in the finished product, or any combination thereof. Following the heating and/or application of pressure, the mold is opened and the molded foam article is removed from the mold.

In some examples, the outsole 104 extends over the midsole 102 to provide increased durability and resiliency. In the illustrated example, the outsole 104 is provided as an outsole material that is overmolded onto the bottom side 116 of the cushion 106 to provide increased durability to the exposed portions of the lower barrier layer 118 of the cushion 106. Accordingly, the outsole material differs from the cushion material as described above. For example, the outsole material may differ from the cushion material, including from the lower barrier membrane, based on at least one of a different thickness, a different hardness, and a different abrasion resistance. In some examples, the outsole 104 may be formed integrally with the lower barrier layer 118 of the cushion 106 using an overmolding process. In other examples, the outsole 104 may be formed separately from the lower barrier layer 118 of the cushion 106 and may be adhesively bonded to the lower barrier layer 118.

With reference again to FIGS. 2A, 2B, and 10-16, the outsole 104 includes the ground-engaging surface 30*a* and a midsole engaging surface 30*b* opposite of the ground-engaging surface 30. The outsole 104 includes a first outsole portion 214, a second outsole portion 216, and a third outsole portion 218. The first outsole portion 214, the second outsole portion 216, and the third outsole portion 218 are spaced apart from each other, allowing for greater flexibility of the sole structure relative to conventional sole structures utilizing an outsole formed as a unitary piece. In particular, the peripheral edge of each of the first outsole portion 214, the second outsole portion 216, and the third outsole portion 218 are spaced apart from each other to allow the different components of the cushion 106 to move relative to each other. Further, as the plurality of chambers 124 are compressed under a load, due to running, walking or jumping movements, the lower portions of the respective chambers 104 are allowed to splay (i.e., move in an outward direction as the chambers 104 deform). In other words, as the first outsole portion 214, the second outsole portion 216, and the third outsole portion 218 are spaced apart from one another, the chambers 104 are allowed to more freely deform in response to an applied load.

The outsole 104 is formed of a first material 220 and a second material 222. The second material 222 is more durable relative to the first material 220 and may be formed from a high-abrasion rubber. Preferably, the second material 222 is disposed on areas of the outsole 104 where portions of the foot engage the ground surface with more force relative to other portions of the foot. As shown, the second material 222 is disposed along the posterior end 20 in the heel region 16, and in the ball portion 12B and the toe portion 12T of the forefoot region 12, which coincides with areas that are more prone to ground engagement.

The first outsole portion 214 includes a heel portion 224, a first medial leg portion 226, and a first lateral leg portion 228. The heel portion 224 is generally arcuate along a length of the heel portion 224 so as to form the shape of a "C." The first medial leg portion 226 and the first lateral leg portion 228 extend in a direction toward an anterior end of the sole structure 100 along respective longitudinal axes that are substantially parallel to a longitudinal axis of the sole structure 100. As such, the first medial leg portion 226 and the first lateral leg portion 228 extend from opposing ends of the heel portion 224 so as to define a generally U-shape structure. The heel portion 224 is configured to be disposed along the posterior end 20 of the foot so as to support the posterior end of the foot. With reference specifically to FIGS. 2A and 11, the heel portion 224 is generally C-shaped when viewed along a width of the heel portion 224. The heel portion 224 has a shape configured to accommodate the bottom side 116 of the posterior lobe 138*i* of the cushion 106. The heel portion 224 tapers from a center of the heel portion 224 towards the respective ends of the heel portion 224 so to accommodate the bulbous shape of the posterior lobe 138*i*.

The first medial leg portion 226 and the first lateral leg portion 228 each include at least a pair of elongated pockets 230*a*-230*d*. Each of the pockets 230*a*-230*d* has a C-shaped cross-section when viewed along a width of the respective first medial leg portion 226 and first lateral leg portion 228, as illustratively shown in FIGS. 2A and 14-16. Similar to the heel portion 224, each of the pockets 230*a*-230*d* tapers from a center of a respective pocket 230*a*-230*d* to each end of the respective pockets 230*a*-230*d* so as to accommodate the shape of a bottom side 116 of a respective lobe 138*e*-138*h* of the cushion 106.

As shown in FIGS. 2B, 10, 11, and 14-16, the first outsole portion 214 is formed of a first material 220 and a second material 222. In one aspect, the first outsole portion 214 includes a seating portion 232*a* configured to receive the second material 222. In particular, the first outsole portion 214 may include a heel insert 234*a* formed of the second material 222. The heel insert 234*a* is illustratively shown as being generally bean-shaped. The seating portion 232*d* is preferably shaped similar to the heel insert 234*a*, wherein the seating portion 232*d* is a recess having a depth that is substantially the same as a height of the heel insert 234*a* and the periphery of the seating portion 232*d* is substantially the same as the periphery of the heel insert 234*a* so as to fittingly receive the heel insert 234*a* and form a generally contiguous surface having different durability. The first medial leg portion 226 and the first lateral leg portion 228 may be formed entirely of the first material 220. In one aspect, not only is the first material 220 less durable than the second material 222, but may be more flexible than the second material 222 as well.

The first outsole portion 214 may include a variable width as measured in a direction extending between the medial side 22 and the lateral side 24 of the sole structure 100 to accommodate the lobes 138*e*-138*i* and recesses 146*e*-146*h* of the cushion 106, as shown in FIG. 10. Specifically, the first medial leg portion 226 and the first lateral leg portion 228 may each include a greater width at the lobes 138*e*-138*i* than at the recesses 146*e*-146*h* due to the shape of the cushion 106 to which the first outsole portion 214 is attached. Providing the first medial leg portion 226 and the first lateral leg portion 228 with a variable width results in the first medial leg portion 226 and the first lateral leg portion 228 alternating between wider and narrower regions in a direction extending substantially parallel to the longitudinal axis A106 of the cushion 106 along both the medial side 22 of the sole structure 100 and the lateral side of the sole structure 100. In one configuration, the first medial leg portion 226 and the first lateral leg portion 228 each includes a greatest width at the medial side 22 and the lateral side 24 proximate to the posterior end 20 of the sole structure 100 and adjacent to a junction of the heel portion 224 and the respective first medial leg portion 226 and first lateral leg portion 228.

The wider and narrower regions of the first medial leg portion 226 and the first lateral leg portion 228 provide the first outsole portion 214 with an undulating shape extending from the medial side 22 to the lateral side 24 and along the posterior end 20. Specifically, the first outsole portion 214 alternates between wider portions (i.e., 230*a*, 230*b*, 230*c*, 230*d*, 234*a*) and narrower portions that are disposed between adjacent wider portions (i.e., 230*a*, 230*b*, 230*c*, 230*d*, 234*a*). Accordingly, the first outsole portion 214 has an undulating shape extending from one end at the medial side 22, along the posterior end 20, to a second end at the lateral side 24 when the first outsole portion 214 is viewed from a bottom of the sole structure 100, as shown in FIG. 10.

The first medial leg portion 226 and the first lateral leg portion 228 may each include distal ends that (i) are arcuate, (ii) oppose the second outsole portion 216, and (iii) are spaced apart from the second outsole portion 216. The distal ends of the first medial leg portion 226 and the first lateral leg portion 228 may be located in the forefoot region 12 or the mid-foot region 14 such that the first outsole portion 214 extends continuously from the heel region 16 to the mid-foot region 14 or the forefoot region 12 along the medial side 22 of the sole structure 100 and the lateral side 24 of the sole structure 100.

The second outsole portion 216 includes a first inner leg portion 236, a second medial leg portion 238, and a second lateral leg portion 240. The first inner leg portion 236 is a generally elongated member having a generally bulbous posterior end. The second medial leg portion 238 and the second lateral leg portion 240 are disposed on an anterior end of the first inner leg portion 236. The second medial leg portion 238 and the second lateral leg portion 240 are generally C-shaped in cross-section, extend in a direction toward the anterior end of the sole structure 100, and include longitudinal axes that are substantially parallel to the longitudinal axis of the sole structure 100. While the second medial leg portion 238 and the second lateral leg portion 240 are described as including longitudinal axes that extend substantially parallel to the longitudinal axis of the sole structure 100, the second medial leg portion 238 and the second lateral leg portion 240 include a generally arcuate shape such that the second medial leg portion 238 and the second lateral leg portion 240 are curved. As shown in FIG. 10, the second medial leg portion 238 is curved such that a distal end of the second medial leg portion 238 extends toward the anterior end 18, away from the medial side 22, and in a direction toward a centerline of the sole structure 100. Similarly, the second lateral leg portion 240 is curved such that a distal end of the second lateral leg portion 240 extends toward the anterior end 18, away from the lateral side 24, and in a direction toward the centerline of the sole structure 100. Based on the foregoing, the distal ends of the second medial leg portion 238 and the second lateral leg portion 240 converge toward one another in the forefoot region 12.

As shown in FIG. 10, the arcuate shape of the second medial leg portion 238 and the second lateral leg portion 240 provides each of the second medial leg portion 238 and the second lateral leg portion 240 with a convex outer surface that opposes the respective medial side 22 of the sole structure 100 and the lateral side 24 of the sole structure 100 and a concave inner surface that opposes the centerline of the sole structure 100. The concave inner surfaces of the second medial leg portion 238 and the second lateral leg portion 240 are spaced apart from and oppose one another across a width of the sole structure 100.

The second medial leg portion 238 and the second lateral leg portion 240 cooperate with a base of the first inner leg portion 236 to provide the second outsole portion 216 with a substantially U-shape in the forefoot region 12. While the second outsole portion 216 is described as including a substantially U-shape in the forefoot region 12, the second outsole portion 216 could include a C-shape in the forefoot region 12 depending on the extent of the curvature of the second medial leg portion 238 and the second lateral leg portion 240. Regardless of the shape of the second outsole portion 216 (i.e., U-shaped or C-shaped), the first inner leg portion 236 extends from the U-shaped or C-shaped portion of the second outsole portion 216 in a direction toward the heel region 16 of the sole structure 100. As shown in FIG. 10, the first inner leg portion 236 initially tapers from a wider region disposed proximate to the second medial leg portion 238 and the second lateral leg portion 240 to a narrow region located between the pockets 230*a*, 230*b* and increases in width from the narrow region to a bulbous end disposed between the pockets 230*c*, 230*d*. The bulbous end includes an outer arcuate surface that opposes the heel insert 234*a*.

As shown in FIGS. 10 and 13-16, the second outsole portion 216 is configured to cover the heel interior chamber 128*b*, the intermediate segment 134*b*, and forefoot lobes 138*c*, 138*d* of the cushion 106. In so doing, the first inner leg portion 236 is disposed between the first medial leg portion 226 and the first lateral leg portion 228 of the first outsole portion 214.

With reference now to FIGS. 10 and 13, the second medial leg portion 238 and the second lateral leg portion 240 each have a C-shaped cross-section when viewed along a width of the second medial leg portion 238 and the second lateral leg portion 240. The second medial leg portion 238 and the second lateral leg portion 240 taper from a center to each end so as to form an elongated bowl shaped structure shaped to accommodate the bottom side 116 of the cushion 106.

The second medial leg portion 238 and the second lateral leg portion 240 may be formed of both the first material 220 and may also include the second material 222. The first material 220 is attached to the cushion 106. In particular, the second outsole portion 216 may include a medial insert 234*b* and a lateral insert 234*c*, both formed of the second material 222. The medial insert 234*b* and lateral insert 234*c* are generally bean shaped members configured to conform to the bottom side of the forefoot lobes 138*c*, 138*d*. The second medial leg portion 238 and the second lateral leg portion 240 include a corresponding medial seating portion 232*b* and a lateral seating portion 232*c*, both formed of the first material 220. The medial seating portion 232*b* and the lateral seating portion 232*c* are preferably shaped similar to corresponding medial insert 234*b* and lateral insert 234*c*, wherein the medial seating portion 232*b* and the lateral seating portion 232*c* are recesses having a depth that is substantially the same as a height of corresponding medial insert 234*b* and lateral insert 234*c*. Further, peripheries of the medial seating portion 232*b* and the lateral seating portion 232*c* are substantially the same as the periphery of the corresponding medial insert 234*b* and lateral insert 234*c* so as to fittingly receive the medial insert 234*b* and lateral insert 234*c* and form a generally contiguous surface having different durability.

The outsole 104 of the present application facilitates the manufacture of the sole structure 100 relative to conventional outsoles formed as a unitary piece. Namely, forming the outsole 104 as separate pieces accounts for manufacturing tolerances and allows for easier assembly of each piece to the midsole 106. As can be appreciated, if the outsole 104 were formed as a unitary component, a small error in alignment (i.e., due to manufacturing tolerances) in the forefoot region of the outsole 104 can have a large effect on aligning a heel region of the outsole 104 relative to the midsole 106. When the components are separately formed, such errors are less pronounced, as the individual components are smaller.

With reference to FIG. 10 and FIGS. 14-16, the first inner leg portion 136 is formed entirely of the first material 220. The third outsole portion 218 includes a second inner leg portion 242, a third medial leg portion 244, and a third lateral leg portion 246. The third medial leg portion 244 and the third lateral leg portion 246 each have a C-shaped cross-section when viewed along a width of the third medial leg portion 244 and the third lateral leg portion 246. The third medial leg portion 244 and the third lateral leg portion 246 taper from a center to each end so as to form an elongated bowl shaped structure shaped to accommodate the bottom side 116 of the cushion 106.

The third medial leg portion 246 and the third lateral leg portion 248 are disposed on an anterior end of the second inner leg portion 242. The third medial leg portion 244 and the third lateral leg portion 246 are generally C-shaped in cross-section, extend in a direction toward the anterior end of the sole structure 100, and include longitudinal axes that are substantially parallel to the longitudinal axis of the sole structure 100. While the third medial leg portion 244 and the third lateral leg portion 246 are described as including longitudinal axes that extend substantially parallel to the longitudinal axis of the sole structure 100, the third medial leg portion 244 and the third lateral leg portion 246 include a generally arcuate shape such that the third medial leg portion 244 and the third lateral leg portion 246 are curved. As shown in FIG. 10, the third medial leg portion 244 is curved such that a distal end of the third medial leg portion 244 extends toward the anterior end 18, away from the medial side 22, and in a direction toward the centerline of the sole structure 100. Similarly, the third lateral leg portion 246 is curved such that a distal end of the third lateral leg portion 246 extends toward the anterior end 18, away from the lateral side 24, and in a direction toward the centerline of the sole structure 100. Based on the foregoing, the distal ends of the third medial leg portion 244 and the third lateral leg portion 246 converge toward one another proximate to the anterior end 18 of the sole structure 100.

As shown in FIG. 10, the arcuate shape of the third medial leg portion 244 and the third lateral leg portion 246 provides each of the third medial leg portion 244 and the third lateral leg portion 246 with a convex outer surface that opposes the respective medial side 22 of the sole structure 100 and the lateral side 24 of the sole structure 100 and a concave inner surface that opposes the centerline of the sole structure 100. The concave inner surfaces of the third medial leg portion 244 and the third lateral leg portion 246 are spaced apart from and oppose one another across a width of the sole structure 100.

The third medial leg portion 244 and the third lateral leg portion 246 cooperate with a base of the second inner leg portion 242 to provide the third outsole portion 218 with a substantially U-shape in the forefoot region 12 proximate to the anterior end 18 of the sole structure 100. While the third outsole portion 218 is described as including a substantially U-shape in the forefoot region 12, the third outsole portion 218 could include a C-shape in the forefoot region 12 depending on the extent of the curvature of the third medial leg portion 244 and the third lateral leg portion 246. Regardless of the shape of the third outsole portion 218 (i.e., U-shaped or C-shaped), the second inner leg portion 242 extends from the U-shaped or C-shaped portion of the third outsole portion 218 in a direction toward the heel region 16 of the sole structure 100. Specifically, the second inner leg portion 242 extends from the U-shaped or C-shaped portion of the third outsole portion 218 away from the anterior end 18 of the sole structure 100 and between the second medial leg portion 238 and the second lateral leg portion 240.

As shown in FIG. 10, the second inner leg portion 242 initially tapers from a wider region disposed proximate to the third medial leg portion 244 and the third lateral leg portion 246 to a narrow region located between distal ends of the second medial leg portion 238 and the second lateral leg portion 240 and increases in width from the narrow region to a bulbous end disposed between the second medial leg portion 238 and the second lateral leg portion 240. The bulbous end includes an outer arcuate surface that opposes a base of the "U" or "C" formed by the second medial leg portion 238 and the second lateral leg portion 240 of the second outsole portion 216. Finally, and as shown in FIG. 10, the distal ends of the second medial leg portion 238 and the second lateral leg portion 240 oppose the narrow region of the second inner leg portion 242 while the concave surfaces of the second medial leg portion 238 and the second lateral leg portion 240 oppose the bulbous end of the second inner leg portion 242.

As shown in FIGS. 10, 12, and 13, the third outsole portion 218 is configured to cover the forefoot region 12 of the sole structure 100. In particular, the third outsole portion 218 is configured to cover the forefoot peripheral chamber **126*b* and the pair of toe lobes 138*a*, 138*b*, wherein the second inner leg portion 242 is disposed between the second medial leg portion 238 and the second lateral leg portion 240. The third outsole portion 218 may be formed entirely of the second material 222**.

As shown in FIGS. 14-16, the first outsole portion 214 is configured to cover the lobes **138*e*-138*i* and preferably leave the lower pocket 158*a* exposed. As shown in FIG. 10, the distal ends of pockets 230*a*, 230*b* terminate at a respective first end 140*e*, 140*f* of the corresponding medial mid-foot lobe 138*e* and lateral mid-foot lobe 138*f* so as to be spaced apart from the second medial leg portion and second lateral leg portion of the second outsole portion 216. Accordingly, the third recess 146*c* and the fourth recess 146*d* of the cushion 106 are unconstrained so as to provide greater flexibility of the sole structure about the third recess 146*c* and the fourth recess 146*d* relative to sole structures incorporating a unitary outsole covering the entire bottom side of the cushion 106**.

The posterior end of the second medial leg portion 238 terminates at the first end of the medial forefoot lobe **138*c* and is spaced apart from an anterior end of the third medial leg portion 244. As such, the first recess 146*a* is exposed between the second medial leg portion 238 and the third medial leg portion 244. The posterior end of the second lateral leg portion 240 terminates at the first end of the lateral forefoot lobe 138*d* and is spaced apart from an anterior end of the third lateral leg portion 246. As such, the second recess 146*b* is exposed between the second lateral leg portion 240 and the third lateral leg portion 246. Accordingly, the first recess 146*a* and the second recess 146*b* of the cushion 106 are unconstrained so as to provide greater flexibility of the sole structure about the first recess 146*a* and the second recess 146***b* relative to sole structures incorporating a unitary outsole covering the entire bottom side of the cushion 106.

With reference again to FIG. 11, the outsole 104 may be formed to have a constant thickness or, alternatively, may have a variable thickness. The outsole 104 shown in the drawings includes a variable thickness to allow the outsole 104 to be thicker in regions of high wear and thinner in regions that don't often contact the ground during use. For example, at Section Line 15-15 of FIG. 10, the outsole 104 may have a reduced thickness when compared to a thickness at the heel insert 234*a*, for example, as the heel insert 234*a* is likely to come into contact with a ground surface during every movement and the portion of the outsole 104 located at Section Line 15-15 will rarely contact the ground surface.

Providing the outsole 104 with localized areas of increased thickness serves to keep the overall weight of the outsole 104 and, thus, the sole structure 100 to a minimum. Further providing areas of reduced thickness provides the sole structure 100 with the ability to more easily flex and move during use.

The upper 300 is attached to the sole structure 100 and includes interior surfaces that define an interior void configured to receive and secure a foot for support on sole structure 100. The upper 300 may be formed from one or more materials that are stitched or adhesively bonded together to form the interior void. Suitable materials of the upper may include, but are not limited to, mesh, textiles, foam, leather, and synthetic leather. The materials may be selected and located to impart properties of durability, air-permeability, wear-resistance, flexibility, and comfort.

The following Clauses provide exemplary configurations for a cushion, a sole structure, and an article of footwear described above.

Clause 1. A sole structure for an article of footwear, the sole structure comprises a cushion including a first series of lobes arranged from a forefoot region to a heel region along a medial side and a lateral side of the sole structure; and an outsole having a first side attached to the cushion, a second side disposed on an opposite side of the outsole than the first side and defining a ground-contacting surface of the sole structure, a first outsole portion having a substantially U-shape and including a first medial leg and a first lateral leg, and a second outsole portion spaced apart and separated from the first outsole portion and having a substantially U-shape including a second medial leg and a second lateral leg, the first medial leg, the first lateral leg, the second medial leg, and the second lateral leg extending toward an anterior end of the sole structure.

Clause 2. The sole structure of Clause 1, wherein the second outsole portion includes an interior leg extending in a direction away from the anterior end.

Clause 3. The sole structure of Clause 2, wherein the interior leg extends between the first medial leg and the first lateral leg.

Clause 4. The sole structure of Clause 2, wherein the second outsole portion includes an arcuate portion extending between and connecting the second medial leg and the second lateral leg, the interior leg extending from the arcuate portion.

Clause 5. The sole structure of any of the preceding Clauses, wherein the first outsole portion includes an arcuate portion extending between and connecting the first medial leg and the first lateral leg.

Clause 6. The sole structure of Clause 5, wherein the arcuate portion extends along a posterior end of the sole structure in the heel region.

Clause 7. The sole structure of any of the preceding Clauses, further comprising a third outsole portion spaced apart and separated from the first outsole portion and the second outsole portion.

Clause 8. The sole structure of Clause 7, wherein the third outsole portion includes a third medial leg and a third lateral leg extending in a direction toward the anterior end of the sole structure.

Clause 9. The sole structure of Clause 8, wherein the third outsole portion includes an arcuate portion extending between and connecting the third medial leg and the third lateral leg.

Clause 10. The sole structure of Clause 9, wherein the third outsole portion includes a substantially U-shape.

Clause 11. The sole structure of Clause 9, wherein the third outsole portion includes an interior leg extending from the arcuate portion in a direction away from the anterior end.

Clause 12. The sole structure of Clause 11, wherein the interior leg extends between the second medial leg and the second lateral leg.

Clause 13. The sole structure of Clause 7, wherein a portion of the cushion is exposed between at least one of (i) the first outsole portion and the second outsole portion and (ii) between the second outsole portion and the third outsole portion.

Clause 14. The sole structure of any of the preceding Clauses, wherein at least one of the first outsole portion and the second outsole portion is formed from at least two different materials.

Clause 15. The sole structure of any of the preceding Clauses, wherein the cushion is a fluid-filled chamber.

Clause 16. The sole structure of any of Clauses 1-14, wherein the cushion is a solid body formed of a resilient polymeric material.

Clause 17. The sole structure of Clauses 1-14, wherein the cushion is a foam element encapsulated in a barrier element.

Clause 18. An article of footwear incorporating the sole structure of any of the preceding Clauses.

Clause 19. A sole structure for an article of footwear, the sole structure comprises a cushion including a first series of lobes arranged from a forefoot region to a heel region along a medial side and a lateral side of the sole structure; and an outsole having a first side attached to the cushion, a second side disposed on an opposite side of the outsole than the first side and defining a ground-contacting surface of the sole structure, a first outsole portion having a substantially U-shape and including a first medial leg and a first lateral leg, and a second outsole portion spaced apart and separated from the first outsole portion and having a substantially U-shape including a second medial leg and a second lateral leg, the first medial leg, the first lateral leg, the second medial leg, and the second lateral leg each including a longitudinal axis that extends substantially parallel to a longitudinal axis of the sole structure.

Clause 20. The sole structure of Clause 19, wherein the second outsole portion includes an interior leg extending in a direction away from an anterior end of the sole structure.

Clause 21. The sole structure of Clause 20, wherein the interior leg extends between the first medial leg and the first lateral leg.

Clause 22. The sole structure of Clause 20, wherein the second outsole portion includes an arcuate portion extending between and connecting the second medial leg and the second lateral leg, the interior leg extending from the arcuate portion.

Clause 23. The sole structure of any of the preceding Clauses, wherein the first outsole portion includes an arcuate portion extending between and connecting the first medial leg and the first lateral leg.

Clause 24. The sole structure of Clause 23, wherein the arcuate portion extends along a posterior end of the sole structure in the heel region.

Clause 25. The sole structure of any of the preceding Clauses, further comprising a third outsole portion spaced apart and separated from the first outsole portion and the second outsole portion.

Clause 26. The sole structure of Clause 25, wherein the third outsole portion includes a third medial leg and a third lateral leg extending in a direction toward an anterior end of the sole structure.

Clause 27. The sole structure of Clause 26, wherein the third outsole portion includes an arcuate portion extending between and connecting the third medial leg and the third lateral leg.

Clause 28. The sole structure of Clause 27, wherein the third outsole portion includes a substantially U-shape.

Clause 29. The sole structure of Clause 27, wherein the third outsole portion includes an interior leg extending from the arcuate portion in a direction away from the anterior end.

Clause 30. The sole structure of Clause 29, wherein the interior leg extends between the second medial leg and the second lateral leg.

Clause 31. The sole structure of Clause 25, wherein a portion of the cushion is exposed between at least one of (i) the first outsole portion and the second outsole portion and (ii) between the second outsole portion and the third outsole portion.

Clause 32. The sole structure of any of the preceding Clauses, wherein at least one of the first outsole portion and the second outsole portion is formed from at least two different materials.

Clause 33. The sole structure of any of Clauses 19-32, wherein the cushion is a fluid-filled chamber.

Clause 34. The sole structure of any of Clauses 19-32, wherein the cushion is solid body formed of a resilient polymeric material.

Clause 35. The sole structure of any of Clauses 19-32, wherein the cushion is a foam element encapsulated in a barrier element Clause 36. An article of footwear incorporating the sole structure of any of the preceding Clauses.

Clause 37. A sole structure for an article of footwear, the sole structure comprising a cushion including a first series of lobes arranged from a forefoot region to a heel region along a medial side and a lateral side of the sole structure and an outsole having a first side attached to the cushion, a second side disposed on an opposite side of the outsole than the first side and defining a ground-contacting surface of the sole structure, a first outsole portion having a substantially U-shape and including a first medial leg and a first lateral leg, and a first insert attached to the first outsole portion and formed from a different material than the first outsole portion.

Clause 38. The sole structure of Clause 37, wherein the first insert is disposed within a pocket defined by the first outsole portion.

Clause 39. The sole structure of any of the preceding Clauses, wherein the first insert is attached one of the first medial leg and the first lateral leg.

Clause 40. The sole structure of Clause 39, further comprising a second insert attached to the first outsole portion and formed from a different material than the first outsole portion.

Clause 41. The sole structure of Clause 38, wherein the second insert is attached to the other of the first medial leg and the first lateral leg.

Clause 42. The sole structure of any of the preceding Clauses, further comprising a second insert attached to the first outsole portion and formed from a different material than the first outsole portion.

Clause 43. The sole structure of any of the preceding Clauses, wherein the first outsole portion includes an arcuate portion extending between and connecting the first medial leg and the first lateral leg.

Clause 44. The sole structure of Clause 43, wherein the first insert is attached to the first outsole portion at the arcuate portion.

Clause 45. The sole structure of any of the preceding Clauses, further comprising a second outsole portion spaced apart and separated from the first outsole portion.

Clause 46. The sole structure of Clause 45, wherein the second outsole portion includes a substantially U-shape having a second medial leg and a second lateral leg.

Clause 47. The sole structure of Clause 46, further comprising a second insert attached to the second outsole portion and formed from a different material than the second outsole portion.

Clause 48. The sole structure of any of Clauses 37-47, wherein the cushion is a fluid-filled chamber.

Clause 49. The sole structure of any of Clauses 37-47, wherein the cushion is solid body formed of a resilient polymeric material.

Clause 50. The sole structure of any of Clauses 37-47, wherein the cushion is a foam element encapsulated in a barrier element.

Clause 51. An article of footwear incorporating the sole structure of any of the preceding Clauses.

Clause 52. A sole structure for an article of footwear, the sole structure comprising a cushion and a first outsole attached to the cushion, defining a ground-contacting surface of the sole structure, and including a substantially U-shape having a first leg extending along a lateral side of the sole structure, a second leg extending along a medial side of the sole structure, and an arcuate segment extending between and connecting the first leg and the second leg, at least one of the first leg and the second leg including a variable width along the length of the at least one of the first leg and the second leg.

Clause 53. The sole structure of Clause 52, wherein the first outsole is disposed in a heel region of the sole structure.

Clause 54. The sole structure of Clause 53, wherein the arcuate segment extends along a posterior end of the sole structure.

Clause 55. The sole structure of Clause 53, further comprising a second outsole spaced apart from the first outsole and disposed closer to an anterior end of the sole structure than the first outsole.

Clause 56. The sole structure of Clause 55, wherein the second outsole includes a first portion disposed proximate to the medial side of the sole structure and a second portion disposed proximate to the lateral side of the sole structure.

Clause 57. The sole structure of Clause 56, wherein the first portion is spaced apart from the second portion across a width of the sole structure.

Clause 58. The sole structure of Clause 56, further comprising a third portion extending between and connecting the first portion and the second portion, the first portion, the second portion, and the third portion cooperating to provide the second outsole with a substantially U-shape.

Clause 59. The sole structure of Clause 58, further comprising a third outsole disposed between the second outsole and the anterior end of the sole structure, the third outsole being spaced apart from the second outsole.

Clause 60. The sole structure of Clause 59, wherein the third outsole includes a substantially U-shape.

Clause 61. The sole structure of any of the preceding Clauses, further comprising a second outsole having a substantially U-shape and spaced apart from the first outsole and a third outsole having a substantially U-shape and spaced apart from the second outsole, the first outsole, the second outsole, and the third outsole each including a longitudinal axis extending substantially parallel to a longitudinal axis of the sole structure.

Clause 62. An article of footwear incorporating the sole structure of any of the preceding Clauses.

Clause 63. A sole structure for an article of footwear, the sole structure comprising: a cushion; and a first outsole attached to the cushion, defining a ground-contacting surface of the sole structure, and including a substantially U-shape having a first segment extending along a lateral side of the sole structure, a second segment extending along a medial side of the sole structure, and an arcuate segment extending between and connecting the first segment and the second segment, the first segment extending from the arcuate segment to a first distal end in a first direction toward a centerline of the sole structure and the second segment extending from the arcuate segment to a second distal end in a second direction toward the centerline of the sole structure.

Clause 64. The sole structure of Clause 63, wherein the first direction is convergent with the second direction.

Clause 65. The sole structure of any of the preceding Clauses, wherein the first segment includes a first concave surface facing the centerline of the sole structure and the second segment includes a second concave surface facing the centerline of the sole structure.

Clause 66. The sole structure of Clause 65, wherein the first concave surface opposes the second concave surface.

Clause 67. The sole structure of Clause 65, wherein the first segment includes a first convex surface formed on an opposite side of the first segment than the first concave surface and the second segment includes a second convex surface formed on an opposite side of the second segment than the second concave surface.

Clause 68. The sole structure of Clause 67, wherein the first convex surface opposes the medial side of the sole structure and the second convex surface opposes the lateral side of the sole structure.

Clause 69. The sole structure of any of the preceding Clauses, further comprising a second outsole having a substantially U-shape and spaced apart from the first outsole.

Clause 70. The sole structure of Clause 69, further comprising a third outsole having a substantially U-shape and spaced apart from the second outsole.

Clause 71. The sole structure of Clause 70, wherein the first outsole, the second outsole, and the third outsole each includes a longitudinal axis extending substantially parallel to a longitudinal axis of the sole structure.

Clause 72. An article of footwear incorporating the sole structure of any of the preceding Clauses.

Clause 73. A sole structure for an article of footwear, the sole structure comprising a cushion including a first series of lobes and a first series of recesses alternatively arranged from a forefoot region to a heel region along a medial side and a lateral side of the sole structure and an outsole having a first side attached to the cushion, a second side disposed on an opposite side of the outsole than the first side and defining a ground-contacting surface of the sole structure, a first outsole portion having a substantially U-shape and including a first medial leg and a first lateral leg, wherein the first medial leg and the first lateral leg each includes a variable width as measured in a direction extending between the medial side and the lateral side of the sole structure to accommodate the lobes and the recesses of the cushion.

Clause 74. The sole structure of Clause 73, wherein the first medial leg and the first lateral leg alternate between wider and narrower regions in a direction extending substantially parallel to a longitudinal axis of the sole structure along both the medial side and the lateral side of the sole structure.

Clause 75. The sole structure of Clause 74, wherein the first outsole portion has an undulating shape extending from one end at the medial side of the sole structure, along a posterior end of the sole structure, to a second end at the lateral side of the sole structure.

Clause 76. The sole structure of any of the preceding Clauses, further comprising a second outsole portion having a substantially U-shape and spaced apart from the first outsole portion.

Clause 77. The sole structure of Clause 76, wherein the second outsole portion includes an interior leg extending in a direction away from an anterior end of the sole structure.

Clause 78. The sole structure of Clause 77, wherein the interior leg extends between the first medial leg and the first lateral leg.

Clause 79. The sole structure of Clause 78, wherein the second outsole portion includes an arcuate portion extending between and connecting a second medial leg and a second lateral leg, the interior leg extending from the arcuate portion.

Clause 80. The sole structure of Clause 76, further comprising a third outsole portion having a substantially U-shape and spaced apart from the second outsole portion.

Clause 81. The sole structure of Clause 80, wherein the third outsole portion includes an interior leg extending in a direction away from an anterior end of the sole structure.

Clause 82. The sole structure of Clause 81, wherein the interior leg extends between the second medial leg and the second lateral leg.

Clause 83. The sole structure of Clause 82, wherein the third outsole portion includes an arcuate portion extending between and connecting a third medial leg and a third lateral leg, the interior leg extending from the arcuate portion.

Clause 84. An article of footwear incorporating the sole structure of any of the preceding Clauses.

The foregoing description has been provided for purposes of illustration and description. It is not intended to be exhaustive or to limit the disclosure. Individual elements or features of a particular configuration are generally not limited to that particular configuration, but, where applicable, are interchangeable and can be used in a selected configuration, even if not specifically shown or described. The same may also be varied in many ways. Such variations are not to be regarded as a departure from the disclosure, and all such modifications are intended to be included within the scope of the disclosure.

What is claimed is:

1. A sole structure for an article of footwear, the sole structure comprising:

a cushion including a series of lobes arranged from a forefoot region to a heel region along a medial side and a lateral side of the sole structure; and an outsole having a first side attached to the cushion, a second side disposed on an opposite side of the outsole than the first side, the second side defining a ground-contacting surface of the sole structure, a first outsole portion having a substantially U-shape extending continuously between and including a first medial leg extending along the medial side of the sole structure from the heel region to at least a mid-foot region of the sole structure and a first lateral leg extending along the lateral side of the sole structure from the heel region to at least the mid-foot region of the sole structure, and a second outsole portion having a substantially U-shape and including a second medial leg extending along the medial side of the sole structure and a second lateral leg extending along the lateral side of the sole structure, the first medial leg, the first lateral leg, the second medial leg, and the second lateral leg each extending toward an anterior end of the sole structure, wherein the first outsole portion comprises a first material and includes a heel insert received in a heel seat formed at a posterior end of the second side of the outsole, the heel insert comprising a second material different than the first material, and the second outsole portion comprises the first material and includes a medial insert and a lateral insert received, respectively, in medial and lateral seats formed on the second side of the outsole, each of the medial insert and the lateral insert comprising the second material.

2. The sole structure of claim 1, wherein the second outsole portion includes an arcuate segment extending between and joining the second medial leg and the second lateral leg.

3. The sole structure of claim 2, wherein the second outsole portion further includes an interior leg extending from the arcuate segment in a direction away from the anterior end.

4. The sole structure of claim 3, wherein the interior leg extends between the first medial leg and the first lateral leg.

5. The sole structure of claim 1, further comprising a third outsole portion spaced apart and separated from the first outsole portion and the second outsole portion.

6. The sole structure of claim 5, wherein the third outsole portion includes a third medial leg extending along the medial side of the sole structure and a third lateral leg extending along the lateral side of the sole structure, the third medial leg and the third lateral leg extending toward the anterior end of the sole structure.

7. The sole structure of claim 6, wherein the third outsole portion includes an arcuate portion extending between and connecting the third medial leg and the third lateral leg.

8. The sole structure of claim 7, wherein the third outsole portion includes an interior leg extending from the arcuate portion in a direction away from the anterior end.

9. The sole structure of claim 1, wherein the first outsole portion and the second outsole portion differ from each other in at least one of appearance and physical properties.

10. The sole structure of claim 1, wherein the cushion comprises at least one of a fluid-filled chamber and a cushion material including one or more polymers.

11. A sole structure for an article of footwear, the sole structure comprising:

a cushion including a series of lobes arranged from a forefoot region to a heel region along a medial side and a lateral side of the sole structure; and an outsole having a first side attached to the cushion, a second side disposed on an opposite side of the outsole than the first side, the second side defining a ground-contacting surface of the sole structure, a first outsole portion having a first medial leg extending continuously along the medial side of the sole structure from the heel region to at least a mid-foot region of the sole structure and a first lateral leg extending continuously along the lateral side of the sole structure from the heel region to at least the mid-foot region of the sole structure, and a second outsole portion having a second medial leg extending along the medial side of the sole structure and a second lateral leg extending along the lateral side of the sole structure, the first medial leg and the first lateral leg being connected by a first transverse segment extending across the sole structure and forming a first curved configuration that opens toward an anterior end of the sole structure and the second medial leg and the second lateral leg being connected by a second transverse segment extending across the sole structure, forming a second curved configuration that opens toward the anterior end of the sole structure, and being aligned with the first curved configuration, wherein the first outsole portion comprises a first material and includes a heel insert received in a heel seat formed at a posterior end of the second side of the outsole, the heel insert comprising a second material different than the first material, and the second outsole portion comprises the first material and includes a medial insert and a lateral insert received, respectively, in medial and lateral seats formed on the second side of the outsole, each of the medial insert and the lateral insert comprising the second material.

12. The sole structure of claim 11, wherein the second outsole portion includes an interior leg extending from the second transverse segment in a direction away from the anterior end.

13. The sole structure of claim 12, wherein the interior leg extends between the first medial leg and the first lateral leg.

14. The sole structure of claim 11, further comprising a third outsole portion spaced apart and separated from the first outsole portion and the second outsole portion.

15. The sole structure of claim 14, wherein the third outsole portion includes a third medial leg extending along the medial side of the sole structure and a third lateral leg extending along the lateral side of the sole structure, the third medial leg and the third lateral leg extending toward the anterior end of the sole structure.

16. The sole structure of claim 15, wherein the third outsole portion includes a third transverse segment extending across the sole structure and forms a third curved configuration that opens toward the anterior end of the sole structure.

17. The sole structure of claim 16, wherein the third curved configuration is aligned with the first curved configuration and the second curved configuration.

18. The sole structure of claim 16, wherein the third outsole portion includes an interior leg extending from the third transverse segment in a direction away from the anterior end.

19. The sole structure of claim 11, wherein the first outsole portion and the second outsole portion differ from each other in at least one of appearance and physical properties.

20. The sole structure of claim 11, wherein the cushion comprises at least one of a fluid-filled chamber and a cushion material including one or more polymers.

* * * * *